US007646364B2

(12) United States Patent
Yamashita et al.

(10) Patent No.: US 7,646,364 B2
(45) Date of Patent: Jan. 12, 2010

(54) PIXEL CIRCUIT, DISPLAY DEVICE, AND A DRIVING METHOD THEREOF

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 945 days.

(21) Appl. No.: 11/290,654

(22) Filed: Nov. 29, 2005

(65) Prior Publication Data

US 2006/0114200 A1 Jun. 1, 2006

(30) Foreign Application Priority Data

Nov. 30, 2004 (JP) ..... P2004-347283

(51) Int. Cl.
*G09G 3/30* (2006.01)

(52) U.S. Cl. ..... 345/77; 345/82

(58) Field of Classification Search ..... 345/38–39, 345/45, 76–78, 82–84, 87–88, 90–95, 98–100, 345/204–205; 315/169.1, 169.3
See application file for complete search history.

(56) References Cited

U.S. PATENT DOCUMENTS

| | | | | |
|---|---|---|---|---|
| 6,774,877 | B2 * | 8/2004 | Nishitoba et al. | 345/76 |
| 7,315,292 | B2 * | 1/2008 | Yamashita | 345/82 |
| 2003/0227262 | A1 | 12/2003 | Kwon | |
| 2004/0046164 | A1 | 3/2004 | Kobayashi et al. | |
| 2004/0070557 | A1 | 4/2004 | Asano et al. | |
| 2008/0007499 | A1 * | 1/2008 | Kawabe | 345/82 |

FOREIGN PATENT DOCUMENTS

| | | |
|---|---|---|
| JP | 2003-150116 | 5/2003 |
| JP | 2003-255856 | 9/2003 |
| JP | 2003-271095 | 9/2003 |

(Continued)

OTHER PUBLICATIONS

Japanese Office Action issued on Jun. 30, 2009, for corresponding Japanese Patent Application JP 2004-347283.

*Primary Examiner*—Richard Hjerpe
*Assistant Examiner*—Mansour M Said
(74) *Attorney, Agent, or Firm*—K&L Gates LLP

(57) ABSTRACT

A pixel circuit, display device, and driving method thereof are provided. The pixel circuit which is disposed in a place where a signal line through which a signal current is caused to flow, and scanning lines through which control signals are supplied, respectively, cross each other and which includes an electroluminescence element, a drive transistor for supplying a drive current to the electroluminescence element, and a control portion adapted to operate in accordance with the control signals for controlling the drive current of the drive transistor based on the signal current, the control portion including first sampling unit for sampling the signal current being caused to flow through the signal line, second sampling unit for sampling a predetermined reference current being caused to flow through the signal line just before or after the signal current, and difference unit for generating a control voltage corresponding to a difference between the sampled signal current and the sampled reference current. The drive transistor receives the control voltage at its gate and supplies a drive current being caused to flow through its source and drain to the electroluminescence element to make the electroluminescence element emit light.

10 Claims, 19 Drawing Sheets

FOREIGN PATENT DOCUMENTS

| | | |
|---|---|---|
| JP | 2004-029791 | 1/2004 |
| JP | 2004-093682 | 3/2004 |
| JP | 2004-093777 | 3/2004 |
| JP | 2004-133240 | 4/2004 |
| JP | 2004-341023 | 12/2004 |
| JP | 2004-354883 | 12/2004 |
| JP | 2005-157347 | 6/2005 |

* cited by examiner

PIXEL CIRCUIT, DISPLAY DEVICE, AND A DRIVING METHOD THEREOF

CROSS REFERENCES TO RELATED APPLICATIONS

The present application claims priority to Japanese Patent Application JP 2004-347283 filed in the Japanese Patent Office on Nov. 30, 2004, the entire contents of which being incorporated herein by reference.

BACKGROUND

The present invention relates to a pixel circuit disposed every pixel for current-driving a corresponding electroluminescence element and a method of driving the same. The present invention also relates to a display device having the pixel circuits disposed in matrix, especially, the so-called active matrix type display device for controlling an amount of current caused to flow through an electroluminescence element such as an organic EL element by using an insulated gate field-effect transistor provided within each pixel circuit, and a method of driving the same.

In an image display device, e.g., a liquid crystal display device, a large number of liquid crystal pixels are arranged in matrix. An image is displayed by controlling transmission intensity or reflection intensity of incident light every pixel in correspondence to information on an image to be displayed. While this is also applied to an organic EL display device having organic EL elements used in pixels, and the like, unlike the liquid crystal pixel, the organic EL element is self-light emitting element. For this reason, the organic EL display device has such advantages that it has higher visibility of an image than that in the liquid crystal display device, a back light is unnecessary, and a response speed is high. In addition, the organic EL display device is largely different from the liquid crystal display device which is of a voltage-controlled type in that it is of the so-called current-controlled type in which a luminance level (gradation) of each electroluminescence element can be controlled based on a value of a current caused to flow through the corresponding electroluminescence element.

In the organic EL display device, similarly to the liquid crystal display device, a simple matrix system and an active matrix system are known as a driving system thereof. Though the former is simple in construction, it involves such a problem that it is difficult to realize a large and high-definition display device, and so forth. Hence, at present, the organic EL display device using the active matrix system is actively being developed. This system is such that a current caused to flow through the electroluminescence element provided inside each pixel circuit is controlled by an active element (generally a thin film transistor (TFT)) provided inside the pixel circuit. The organic EL display device using this system is described in the following patent documents (Japanese Patent Laid-Open No. 2003-255856, Japanese Patent Laid-Open No. 2003-271095, Japanese Patent Laid-Open No. 2004-133240, Japanese Patent Laid-Open No. 2004-029791, Japanese Patent Laid-Open No. 2004-093682.)

FIG. 22 is a schematic block diagram showing a conventional organic EL display device using an active matrix system. As shown in the figure, this display device is constituted by a pixel array 1 as a main portion, and a peripheral circuit portion. The peripheral circuit portion includes a current driver 3, a light scanner 4, a drive scanner 5, and a scanner 7 for correction. The pixel array 1 is constituted by row-distributed lines WS, column-distributed signal lines SL, and pixels R, G and B which are disposed in matrix in places where the row-distributed lines WS and the column-distributed signal lines SL cross each other. While the pixels of the three primary colors of RGB are prepared in order to make the color display possible, single color pixels for black-and-white display are be used instead in some cases. The pixels R, G and B are constituted by pixel circuits 2, respectively. The signal line SL is driven by the current driver 3, so that a signal current is caused to flow through the signal line SL. The scanning lines WS are scanned by the light scanner 4. Incidentally, different scanning lines DS and AZ are also distributed in parallel with the scanning lines WS. The scanning lines DS are scanned by the drive scanner 5. The drive scanner 5 controls an electroluminescence period of an electroluminescence element included in each pixel. The scanning lines AZ are scanned by the scanner 7 for correction. The light scanner 4, the drive scanner 5 and the scanner 7 for correction constitute a scanner portion as a whole. The scanner portion successively scans the rows of the pixels every one horizontal period.

FIG. 23 is a circuit diagram showing an example of a structure of the pixel circuit shown in FIG. 22. As shown in the figure, the pixel circuit 2 is constituted by four transistors Tr1, Tr4, Tr5 and Trd, one pixel capacitor Cs, and one electroluminescence element EL. The four transistors are all thin film transistors. Of those transistors, the transistors Tr1, Tr4 and Tr5 are switching transistors for control, and are of an N-channel type each. On the other hand, the transistor Trd is a drive transistor for driving the electroluminescence element EL and is of a P-channel type. In addition, the electroluminescence element EL is a two-terminal type self-light emitting element including an anode and a cathode. For example, an organic EL element can be used as the electroluminescence element EL.

A source S of the drive transistor Trd is connected to a power source $V_{cc}$. A drain D of the drive transistor Trd is located on the anode side of the electroluminescence element EL. The cathode side of the electroluminescence element EL is grounded. A gate G of the drive transistor Trd is connected to one end of the pixel capacitor Cs. The other end of the pixel capacity Cs is connected to the power source $V_{cc}$.

A source/drain of the switching transistor Tr1 is connected between the signal line SL and the gate G of the drive transistor Trd. A gate of the switching transistor Tr1 is connected to the scanning line WS. A source/drain of the switching transistor Tr4 is connected between the gate G and drain D of the drive transistor Trd. A gate of the switching transistor Tr4 is connected to the scanning line AZ. A source/drain of the switching transistor Tr5 is connected between the drain D of the drive transistor Trd and the anode of the electroluminescence element EL. A gate of the switching transistor Tr5 is connected to the scanning line DS. The drive transistor Trd operates in a saturated region, and its characteristics are expressed by Expression 1:

$$I_{ds} = \frac{k\mu}{2}(V_{gs} - V_{th})^2$$

In Expression 1, $V_{gs}$ is a gate voltage and represents a voltage developed across the source S and gate G of the drive transistor Trd. $I_{ds}$ is a drain current and caused to flow through the source S and drain D of the drive transistor Trd to be supplied to the electroluminescence element EL. $V_{th}$ represents a threshold voltage of the drive transistor Trd. μ represents carrier mobility of the drive transistor Trd. Also, k is a constant and given by Cox·W/L where Cox, W and L are a gate capacity, a channel width, and a channel length of the drive transistor Trd, respectively. The constant k is called a size factor in some cases. As apparent from Expression 1, when the drive transistor Trd operates in the saturated region, the drain current $I_{ds}$ starts to be caused to flow from a time point when the gate voltage $V_{gs}$ exceeds the threshold voltage $V_{th}$. The magnitude of the drain current $I_{ds}$ increases in proportion to the square of the gate voltage $V_{gs}$. Incidentally, in this specification, it is assumed that the threshold voltage $V_{th}$ of the drive transistor Trd takes its absolute value. By the way, since the threshold value of the P-channel transistor has a negative value, when this value is substituted into Expression 1 as it is, this is not proper. For this reason, in this specification, the threshold voltage takes its absolute value, and thus the threshold voltage $V_{th}$ is treated as a positive value.

The drive transistor Trd, for example, is a TFT having an active layer made of a polycrystalline silicon thin film. Low-temperature polysilicon which is crystallized in the laser annealing process is used in the polycrystalline silicon thin film in many cases. In general, the low-temperature polysilicon TFT has a tendency to disperse in threshold voltage $V_{th}$ and carrier mobility μ every device. In other words, the threshold voltage $V_{th}$ and carrier mobility μ of the drive transistor Trd differ among the individual pixel circuits 2.

An operation of the pixel circuit 2 is roughly classified into a sampling operation and an electroluminescence operation. In the first sampling operation, the pixel circuit 2 turns off the switching transistor Tr5, while it turns on the switching transistors Tr1 and Tr4. When the current driver 3 drives the signal line SL in this state, a signal current $I_{sig}$ is caused to flow from the power source $V_{cc}$ into the signal line SL through the drive transistor Trd, and the switching transistors Tr4 and Tr1. The operating characteristics of the drive transistor Trd at this time are expressed by Expression 2:

$$I_{sig} = \frac{k\mu}{2}(V_{gs} - V_{th})^2$$

Expression 2 is expressed such that the drain current $I_{ds}$ in Expression 1 is replaced with the signal current $I_{sig}$.

A gate voltage $V_{gs}$ which is developed across the gate G and source S of the drive transistor Trd when the signal current $I_{sig}$ is caused to flow is expressed by Expression 3 by solving Expression 2 for $$V_{gs}V_{gs} = \sqrt{\frac{2I_{sig}}{k\mu}} + V_{th}.$$

The gate voltage $V_{gs}$ expressed by Expression 3 is held in the pixel capacitor Cs. In such a manner, in the sampling operation, the gate voltage $V_{gs}$ corresponding to the level of the signal current $I_{sig}$ supplied by the current driver 3 is written to the pixel capacitor Cs. In brief, the signal current $I_{sig}$ is written to the gate of the drive transistor Trd.

Next, in the electroluminescence operation, the switching transistors Tr1 and Tr4 are turned off, while the switching transistor Tr5 is turned on. As a result, a drive current $I_{ds}$ is caused to flow from the drive transistor Trd into the electroluminescence element EL, so that the electroluminescence element EL emits light at predetermined luminance. The drive current $I_{ds}$ which is caused to flow through the drive transistor Trd at this time is expressed by Expression 4:

$$\begin{aligned} I_{ds} &= \frac{k\mu}{2}(V_{gs} - V_{th})^2 \\ &= \frac{k\mu}{2}\left(\sqrt{\frac{2I_{sig}}{k\mu}} + V_{th} - V_{th}\right)^2 \\ &= I_{sig} \end{aligned}$$

When $V_{gs}$ obtained from Expression 3 is substituted into $V_{gs}$ in Expression 4 and Expression 4 is then rearranged, finally, the terms of the mobility μ and the threshold voltage $V_{th}$ are canceled so that a relationship of $I_{ds}=I_{sig}$ is obtained. Consequently, even when the mobility μ and threshold voltage $V_{th}$ of the drive transistor Trd disperse among the individual pixels, the dispersion in the mobility μ and threshold voltage $V_{th}$ of the drive transistor Trd is canceled by performing the above-mentioned signal current writing operation, and thus the uniformity of the picture can be maintained.

The conventional pixel circuit shown in FIG. 23 has such an advantage that the drive current $I_{ds}$ equal to the signal current $I_{sig}$ can be supplied to the electroluminescence element EL irrespective of the dispersion in mobility μ and threshold voltage $V_{th}$ of the drive transistor Trd. The current driver 3 can change the luminance of the electroluminescence element EL from the black level up to the white level through the intermediate gray level by gradation-controlling the signal current $I_{sig}$. When the luminance of the electroluminescence element EL is at the black level, the signal current $I_{sig}$ becomes weak so that its magnitude approaches zero, while when the luminance of the electroluminescence element EL is at the white level, the signal current $I_{sig}$ becomes a large current. However, the parasitic capacity of the signal line SL takes a relatively large value, i.e., several tens of pF. As a result, there is encountered such a problem that with the conventional structure shown in FIG. 23, the weak signal current $I_{sig}$ when the luminance of the electroluminescence element EL is at the black level cannot be sufficiently written within one horizontal image period (1H) allocated to the sampling operation.

FIG. 24 is a diagram schematically representing this problem. A case is shown where a pixel array 1 constitutes a picture, and a white window is displayed against a black background on the picture area. A gray portion appears under the while window. Essentially, this gray portion belongs to the background and thus must be black. However, with the conventional pixel circuit structure shown in FIG. 23, the signal current corresponding to the block level cannot be written to any of the pixels located under the white window. Hence, the black embossing, the longitudinal cross-talk or the like as shown in FIG. 24 is generated. This becomes a problem to be solved.

SUMMARY

In the light of the above-mentioned problems associated with the related art, and it is, therefore, desired to provide a pixel circuit and a display device which are capable of sufficiently writing even a signal current corresponding to a black level, and a driving method thereof.

According to an embodiment of the present invention, it is desired to provide a pixel circuit which is disposed in a place where a signal line through which a signal current is caused to flow, and scanning lines through which control signals are supplied, respectively, cross each other and which includes an electroluminescence element, a drive transistor for supplying a drive current to the electroluminescence element, and a control portion adapted to operate in accordance with the control signals for controlling the driving current of the drive transistor based on the signal current. The control portion includes: first sampling means for sampling the signal current being caused to flow through the signal line; second sampling means for sampling a predetermined reference current being caused to flow through the signal line just before or after the signal current; and difference means for generating a control voltage corresponding to a difference between the sampled signal current and the sampled reference current. The drive transistor receives the control voltage at its gate and supplies a drive current being caused to flow through its source and drain to the electroluminescence element to make the electroluminescence element emit light.

More specifically, when a relative difference between the signal current and the reference current sampled by the first and second sampling means, respectively, is small, an amount of electroluminescence of the electroluminescence element becomes little, and when the relative difference between the signal current and the reference current is large, the amount of electroluminescence becomes much, while absolute levels of the signal current and reference current are set as large enough to make the sampling possible even when the relative difference between the signal current and the reference current is small.

Preferably, the intra-pixel control portion includes correcting means for detecting a threshold voltage of the drive transistor to add the detected threshold voltage to the control voltage, so that an influence of the threshold voltage is canceled from the drive current.

Preferably, the first sampling means samples a signal voltage generated when the signal current is caused to flow through the drive transistor, the second sampling means samples a reference voltage generated at the gate of the drive transistor when the reference current is caused to flow through the drive transistor, and the difference means obtains a difference between the signal voltage and the reference voltage by coupling the signal voltage and the reference voltage to each other through a capacitor to generate the control voltage.

In this case, the first sampling means has a first capacitor for holding therein the sampled signal voltage, the second sampling means has a second capacitor for holding therein the sampled reference voltage, the second capacitor being adapted to be coupled to the signal voltage, and the first and second capacitors have the same capacitance value.

According to an embodiment of the present invention, there is provided a method of driving a pixel circuit which is disposed in a place where a signal line through which a signal current is caused to flow, and scanning lines through which control signals are supplied, respectively, cross each other, and which includes an electroluminescence element, a drive transistor for supplying a drive current to the electroluminescence element, and a control portion adapted to operate in accordance with the control signals for controlling a drive current of the drive transistor based on the signal current. The method includes the steps of sampling a signal current being caused to flow through the signal line, sampling a predetermined reference current being caused to flow through the signal line just before or after the signal current, generating a control voltage corresponding to a difference between the sampled signal current and the sampled reference current, and applying the control voltage to a gate of the drive transistor and applying a drive current being caused to flow through a source and a drain of the drive transistor to the electroluminescence element.

More specifically, when a relative difference between the signal current and the reference current sampled by the first and second sampling means, respectively, is small, an amount of electroluminescence of the electroluminescence element becomes little, and when the relative difference between the signal current and the reference current is large, the amount of electroluminescence becomes much, while absolute levels of the signal current and reference current are set as large enough to make the sampling possible even when the relative difference between the signal current and the reference current is small.

Preferably, the intra-pixel control portion includes correcting means for detecting a threshold voltage of the drive transistor to add the detected threshold voltage to the control voltage, so that an influence of the threshold voltage is canceled from the drive current.

According to an embodiment of the present invention, there is provided a method of driving a pixel circuit which is disposed in a place where a signal line through which a signal current is caused to flow, and scanning lines through which control signals are supplied, respectively, cross each other, and which includes an electroluminescence element, a drive transistor for supplying a drive current to the electroluminescence element, and a control portion adapted to operate in accordance with the control signals for controlling a drive current of the drive transistor based on the signal current. The method includes the steps of sampling a signal current being caused to flow through the signal line, sampling a predetermined reference current being caused to flow through the signal line just before or after the signal current, generating a control voltage corresponding to a difference between the sampled signal current and the sampled reference current, and applying the control voltage to a gate of the drive transistor and applying a drive current being caused to flow through a source and a drain of the drive transistor to the electroluminescence element.

According to an embodiment of the present invention, there is provided a method of driving a display device including a pixel array portion, a driver portion and a scanner portion, the pixel array portion including column-distributed signal lines, row-distributed scanning lines, and pixel circuits disposed in matrix in places where the column-distributed signal lines and the row-distributed scanning lines cross each other, the driver portion serving to cause signal currents to flow through the signal lines, respectively, the scanner portion serving to supply control signals to the scanning lines, respectively, each pixel circuit including an electroluminescence element, a drive transistor for supplying a drive current to the electroluminescence element, and an intra-pixel control portion adapted to operate in accordance with the control signals for controlling the drive current of the drive transistor. The method includes the steps of sampling a signal current being caused to flow through the signal line, sampling a predetermined reference current being caused to flow through the signal line just before or after the signal current, generating a control voltage corresponding to a difference between the sampled signal current and the sampled reference current, and applying the control voltage to a gate of the drive transistor and applying a drive current being caused to flow through a source and a drain of the drive transistor to the electroluminescence element.

The display device according to the present invention supplies not only the signal current, but also the reference current from the current driver side. The pixel circuit samples the signal current and the reference current which are caused to flow almost simultaneously with each other, and obtains a difference between the signal current and the reference current to set the difference as the gate control voltage. As a result, the drive transistor can drive the electroluminescence element in accordance with the difference between the signal current and the reference current. In this connection, when the luminance of the electroluminescence element is at the black level, the difference becomes near zero, so that the signal current becomes nearly equal to the reference current. Even in such a state, the absolute values of the signal current and the reference current can be set as sufficiently high against the parasitic capacity of the signal line. Consequently, even the current when the luminance of the electroluminescence element is at the black level can be written to the pixels at sufficiently high speed. As a result, it is possible to prevent the black embossing and the longitudinal cross-talk which have been conventionally a problem. The levels of the signal current and the reference current can be set as sufficiently high without depending on the luminance gradation to be displayed. Hence, even a current corresponding to the black display can be sufficiently written to the pixels within one horizontal period. Thus, it is possible to express the black in which the luminance is sufficiently deep, and it is possible to obtain the high contrast characteristics. In addition, the difference between the signal current and the reference current is obtained to control the drive current for the electroluminescence element without depending on the threshold voltage and mobility of the drive transistor. Hence, the image having high uniformity can be displayed without being influenced by the dispersion in characteristics of the drive transistor. In particular, the large effects of the present invention are obtained in the pixel circuit using the low-temperature polysilicon TFT in which the mobility and the threshold voltage largely disperse.

Additional features and advantages are described herein, and will be apparent from, the following Detailed Description and the figures.

DETAILED DESCRIPTION

Figure 1:
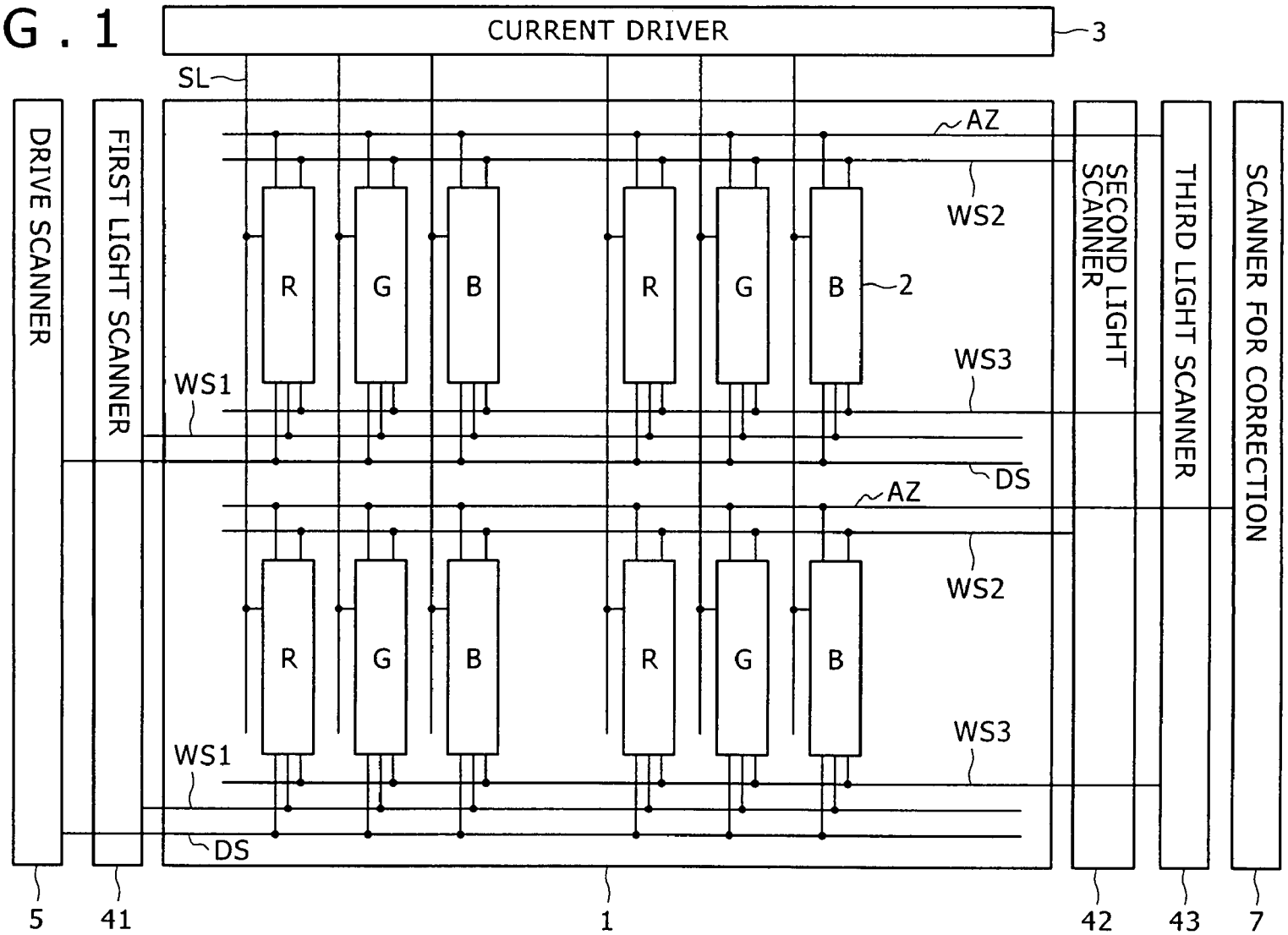
FIG. 1 is a schematic overall block diagram showing a pixel circuit and a display device according to an embodiment of the present invention.

FIG. 1 is a block diagram showing an overall construction of a display device according to an embodiment of the present invention. As shown in the figure, this display device is of an active matrix type, and constituted by a pixel array 1 as a main portion and a peripheral circuit portion. The peripheral circuit portion includes a current driver 3, a first light scanner 41, a second light scanner 42, a third light scanner 43, a drive scanner 5, a scanner 7 for correction, and the like. The pixel array 1 is constituted by pixels R, G and B which are disposed in matrix in places where row-distributed scanning lines WS and column-distributed signal lines SL cross each other. Each of the pixels R, G and B is constituted by a pixel circuit 2. The signal lines SL are driven by the current driver 3. In other words, the current driver 3 alternately causes signal currents and reference currents to flow through the signal lines SL. The scanning line WS is actually separated into three scanning lines WS1, WS2 and WS3. The first scanning lines WS1 are scanned by the first light scanner 41. The next scanning lines WS2 are scanned by the second light scanner 42. The remaining scanning lines WS3 are scanned by the third light scanner 43. Control signals which are supplied to those scanning lines WS1, WS2 and WS3, respectively, are different in timing from one another. In addition, different scanning lines DS and AZ are also distributed in parallel with the scanning lines WS1, WS2 and WS3. The scanning lines DS are scanned by the drive scanner 5. The driver scanner 5 controls an electroluminescence period of an electroluminescence element included in each pixel. The scanning lines AZ are scanned by the scanner 7 for correction. The light scanners 41, 42 and 43, the drive scanner 5, and the scanner 7 for correction constitute a scanner portion as a whole which successively scans the rows of the pixels every one horizontal period.

Figure 2:
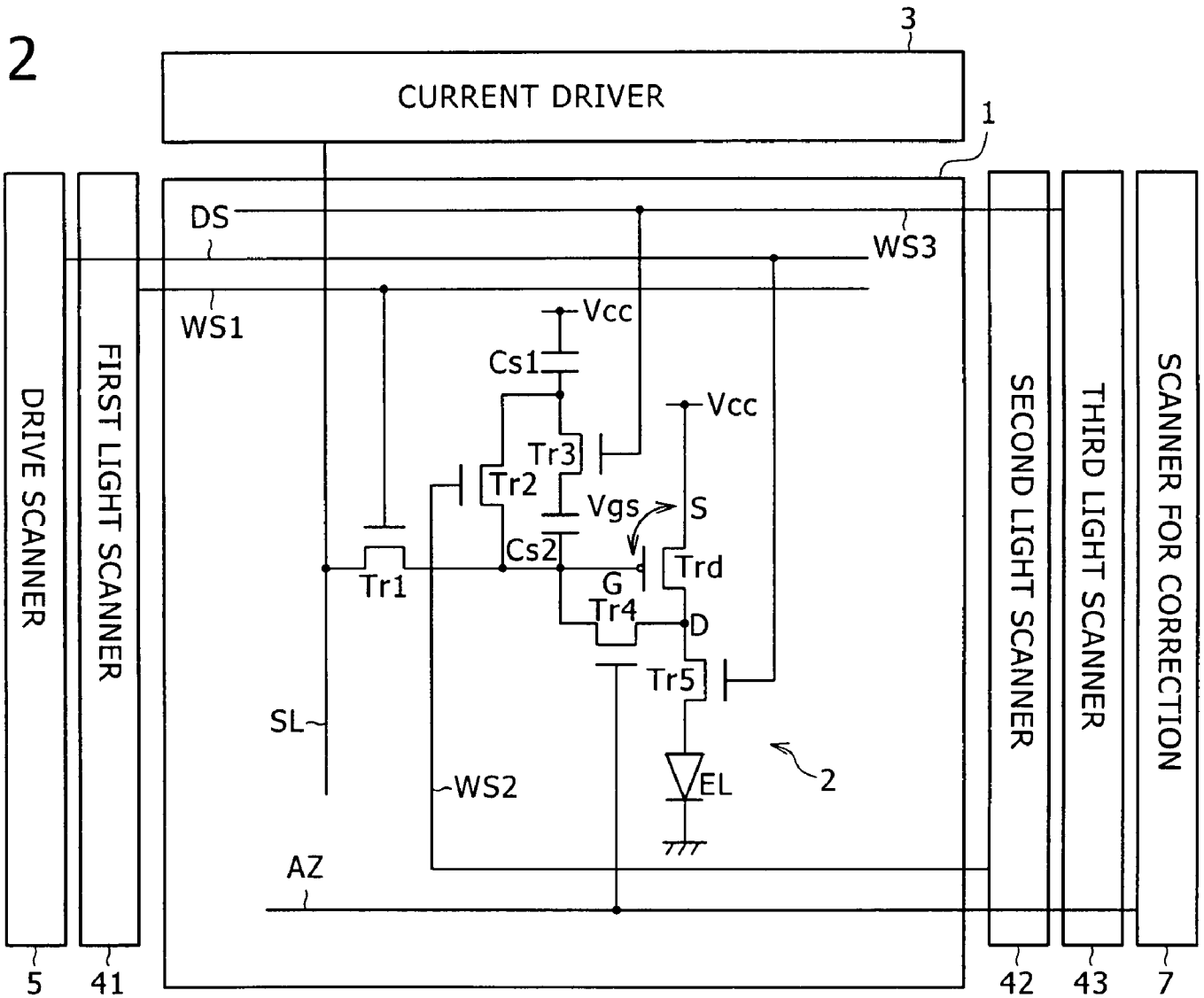
FIG. 2 is a circuit diagram showing a structure of the pixel circuit included in the display device shown in FIG. 1.

FIG. 2 is a circuit diagram showing a structure of the pixel circuit 2 shown in FIG. 1. This pixel circuit 2 is constituted by six thin film transistors Tr1, Tr2, Tr3, Tr4, Tr5 and Trd, two pixel capacitors $C_{s1}$ and $C_{s2}$, and one electroluminescence element EL. Of the six thin film transistors Tr1, Tr2, Tr3, Tr4, Tr5 and Trd, the transistors Tr1 to Tr5 for switching control are of an N-channel type each. The remaining transistor Trd is a drive transistor for driving the electroluminescence element EL. The drive transistor Trd is of a P-channel type. In this embodiment, each of those six thin film transistors Tr1, Tr2, Tr3, Tr4, Tr5 and Trd has a channel region made of a low-temperature polysilicon thin film. The electroluminescence element EL is a two-terminal type device including an anode and a cathode. For example, an organic EL element can be used as the electroluminescence element EL. It should be noted that while in the above-mentioned embodiment, all the transistors Tr1 to Tr5 are of the N-channel type each, all those transistors Tr1 to Tr5 may be of a P-channel type each, or the N-channel transistors and the P-channel transistors may be mixedly used as the transistors Tr1 to Tr5.

A source S of the drive transistor Trd is connected to a power source $V_{cc}$. A drain of the drive transistor Trd is connected to an anode side of the electroluminescence element EL. A cathode of the electroluminescence element EL is grounded. Incidentally, a cathode grounding potential of the electroluminescence element EL is expressed by $V_{cathode}$ in some cases. A gate G of the drive transistor Trd is connected to one end of the pixel capacitor Cs2. The other end of the pixel capacitor Cs2 is connected to one end of the other pixel capacitor Cs1. The other end of the pixel capacitor Cs1 is connected to the power source $V_{cc}$.

A source/drain of the switching transistor Tr1 is connected to the signal line SL and the gate G of the drive transistor Trd, and a gate of the switching transistor Tr1 is connected to the first light scanner 41 through the scanning line WS1. A source/drain of the switching transistor Tr2 is connected between the gate of the drive transistor Trd and one end of the pixel capacitor Cs1, and a gate of the switching transistor Tr2 is connected to the second light scanner 42 through the scanning line WS2. A source/drain of the switching transistor Tr3 is connected between a pair of pixel capacitors Cs1 and Cs2, and a gate of the switching transistor Tr3 is connected to the third light scanner 43 through the scanning line WS3. A source/drain of the switching transistor Tr4 is connected between the gate G and drain D of the drive transistor Trd, and a gate of the switching transistor Tr4 is connected to the scanner 7 for correction through the scanning line AZ. A source/drain of the switching transistor Tr5 is connected between the drain D of the drive transistor Trd and the anode of the electroluminescence element EL, and a gate of the switching transistor Tr5 is connected to the drive scanner 5 through the scanning line DS.

Figure 3:
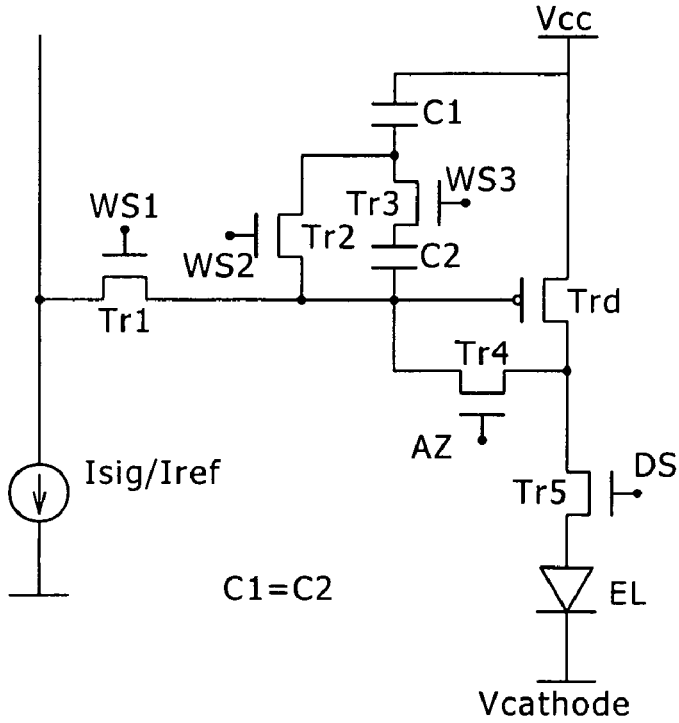
FIG. 3 is a schematic circuit diagram explaining an operation of the pixel circuit shown in FIG. 2.

FIG. 3 is a schematic circuit diagram explaining an operation of the pixel circuit shown in FIG. 2. As shown in the figure, a signal current $I_{sig}$ and a reference current $I_{ref}$ are alternately caused to flow from the current driver into the signal line. In addition, control signals are supplied from the scanners to the gates of the switching transistors Tr through the corresponding scanning lines, respectively. In the figure, for the sake of making the understanding easy, the control signals are designated with the same reference symbols as those of the scanning lines. For example, the control signal applied to the gate of the switching transistor Tr1 is designated with WS1. Likewise, the control signal applied to the gate of the switching transistor Tr2 is designated with WS2, the control signal for the switching transistor Tr3 is designated with WS3, the control signal for the switching transistor Tr4 is designated with AZ, and the control signal for the switching transistor Tr5 is designated with DS. In addition, capacitance values C1 and C2 of a pair of pixel capacitors Cs1 and Cs2 are illustrated. In this embodiment, the capacitance values C1 and C2 of a pair of pixel capacitors Cs1 and Cs2 are set as equal to each other.

Figure 4:
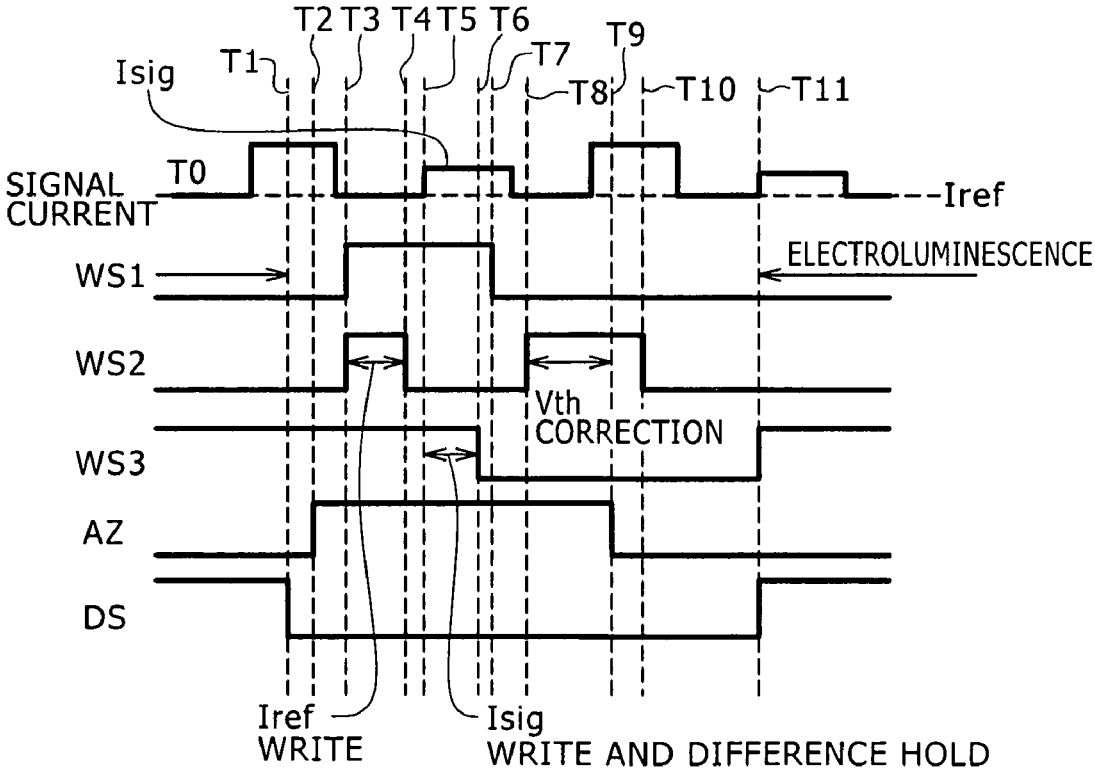
FIG. 4 is a timing chart explaining the operation of the pixel circuit shown in FIG. 2.

FIG. 4 is a timing chart explaining the operation of the pixel circuit shown in FIG. 3. In the figure, waveforms of the signal current, and the control signals WS1, WS2, WS3, AZ and DS are represented along a time axis. The signal current $I_{sig}$ changes every one horizontal period (1H), and is allocated to the pixels belonging to the corresponding rows, respectively. The current level changes between the signal current $I_{sig}$ and the reference current $I_{ref}$ within 1H. The reference current $I_{ref}$ is previously set to a predetermined level. The signal current $I_{sig}$ changes every 1H with the reference current $I_{ref}$ as a reference. The luminance of the electroluminescence becomes large as the level of the signal current $I_{sig}$ becomes higher.

At timing T0, the control signals WS1, WS2 and AZ are at a low level each, while the control signals WS3 and DS are set at a high level each. Since each switching transistor is of the N-channel type, it becomes an on state when the corresponding control signal is at the high level, while it becomes an off state when the corresponding control signal is at the low level. Since at the timing T0, the control signal DS is at the high level, the switching transistor Tr5 is in the on state. Thus, since the drive current is caused to flow from the drive transistor Tr5 into the electroluminescence element EL, the pixel circuit is in an electroluminescence state.

When the operation proceeds from the timing T0 to timing T1, the control signal DS becomes a low level, and thus the state of the electroluminescence element EL is changed from the electroluminescence state over to a non-electroluminescence state. At timing T2, the control signal AZ becomes a high level. Moreover, at timing T3, the control signals WS1 and WS2 also become a high level each. At this time, the reference current $I_{ref}$ is being caused to flow through the signal line SL. When the operation proceeds to timing T4, the control signal WS2 returns back to the low level. For a period from the timing T3 to the timing T4, the reference current $I_{ref}$ is written to the pixel capacitor C1.

Subsequently, when the operation proceeds to timing T5, the current which is caused to flow through the signal line SL is changed from the reference current $I_{ref}$ over to the signal current $I_{sig}$. Moreover, at timing T6, the control signal WS3 becomes the low level. For a period from the timing T5 to the timing T6, the operation for writing the signal current $I_{sig}$ and an operation for holding a difference between the reference signal $I_{ref}$ and the signal current $I_{sig}$ are performed.

Thereafter, at timing T7, the control signal WS1 falls. Furthermore, at timing T8, the control signal WS2 becomes the high level again. Subsequently, at timing T9, the control signal AZ returns back to the low level. For a period from the timing T8 to the timing T9, an operation for correcting a threshold voltage $V_{th}$ of the drive transistor Trd is performed.

Moreover, when the operation proceeds to timing T10, the control signal WS2 returns back to the low level. At timing T11, the control signal WS3 becomes the high level and the control signal DS also becomes the high level. As a result, an electroluminescence operation is performed.

Figure 5:
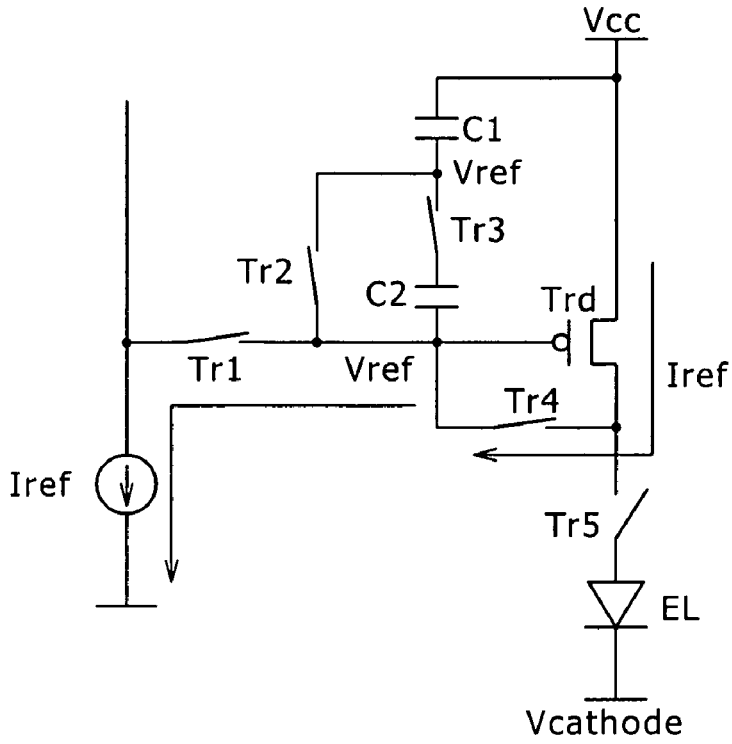
FIG. 5 is a schematic circuit diagram explaining the operation of the pixel circuit shown in FIG. 2.

FIG. 5 is a schematic circuit diagram showing the operation for writing the reference current $I_{ref}$ which is performed for the period T3 to T4 shown in the timing chart of FIG. 4. For the period T3 to T4, the reference current $I_{ref}$ is being caused to flow through the signal line SL. Also, the switching transistors Tr1 to Tr4 are in the on state each, while the switching transistor Tr5 is in the off state. Consequently, the reference current $I_{ref}$ is caused to flow from the power source $V_{cc}$ into the signal line SL side through the drive transistor Trd, and the switching transistors Tr4 and Tr1. As a result, a potential $V_{ref}$ corresponding to the reference current $I_{ref}$ is developed at the gate of the drive transistor Trd. At this time, a gate voltage $V_{gs}$ of the drive transistor Trd is expressed by Expression 5: $V_{gs}=V_{cc}-V_{ref}$ Consequently, a characteristic expression when the reference current $I_{ref}$ is caused to flow through the drive transistor Trd is expressed by Expression 6:

$$I_{ref} = \frac{k\mu}{2}(V_{gs} - V_{th})^2 = \frac{k\mu}{2}(V_{cc} - V_{ref} - V_{th})^2$$

In Expression 6, a relationship between the reference circuit $I_{ref}$ and the reference potential $V_{ref}$ is obtained by substituting $(V_{cc}-V_{ref})$ in Expression 5 into the gate voltage $V_{gs}$.

Here, rearranging Expression 6 for $V_{ref}$, Expression 7 is obtained $$V_{ref} = V_{cc} - V_{th} - \sqrt{\frac{2I_{ref}}{k\mu}}$$

The reference potential $V_{ref}$ which is obtained in such a manner is written to the capacitor C1 through the switching transistor Tr2 in the on state.

Figure 6:
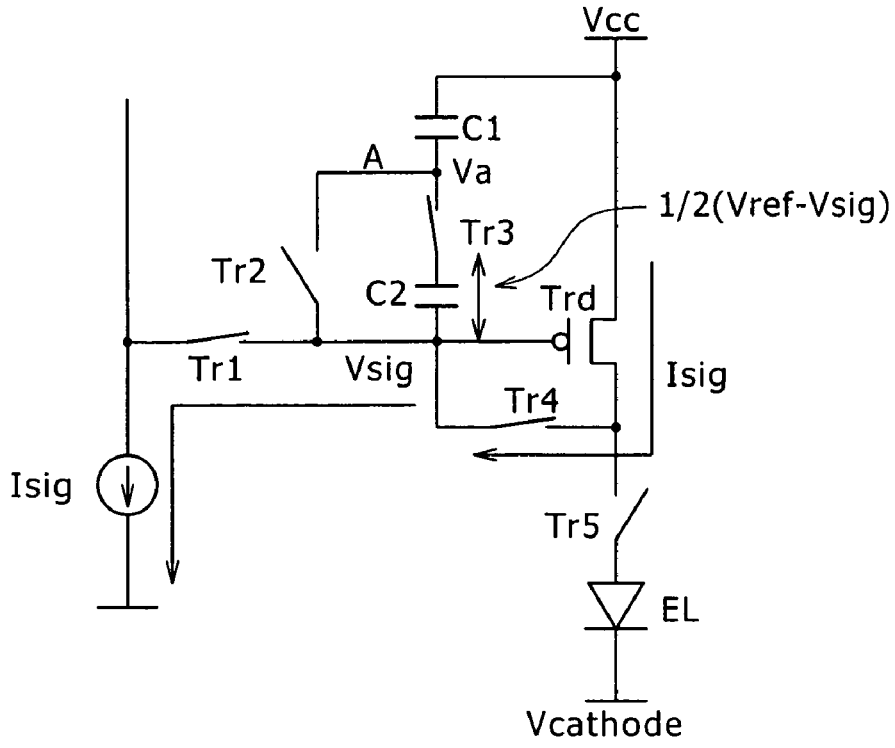
FIG. 6 is a schematic circuit diagram explaining the operation of the pixel circuit shown in FIG. 2.

FIG. 6 is a schematic circuit diagram showing the signal current $I_{sig}$ writing operation and the current difference holding operation which are performed for the period T5 to T6 of the timing chart shown in FIG. 4. For the period T5 to T6, the signal current $I_{sig}$ is caused to flow through the signal line SL. Also, the switching transistors Tr1, Tr3 and Tr4 are in the on state each, while the switching transistors Tr2 and Tr5 are in the off state each. In this state, the signal current $I_{sig}$ is caused to flow from the power source $V_{cc}$ into the signal line SL through the drive transistor Trd, and the switching transistors Tr4 and Tr1. As a result, the gate potential $V_{gs}$ of the drive transistor Trd changes from the reference potential $V_{ref}$ to a signal potential $V_{sig}$. Similarly to obtaining the reference potential $V_{ref}$ from Expression 7, the signal potential $V_{sig}$ is obtained from Expression 8:

$$V_{sig} = V_{cc} - V_{th} - \sqrt{\frac{2I_{sig}}{k\mu}}$$

A potential change $(V_{sig}-V_{ref})$ developed at the gate of the drive transistor Trd is coupled to a node A through the capacitor C2. The node A is a node between a pair of capacitors C1 and C2, and a potential at the node A is expressed by $V_a$. A capacitive coupling part of the change in gate potential is expressed by $(V_{sig}-V_{ref})\cdot C2/(C1+C2)$. Since the capacitive coupling part is added to the potential $V_{ref}$ at which the node A is essentially, the potential $V_a$ at the node A is expressed by Expression 9:

$$V_a = V_{ref} + \frac{C2}{C1 + C2}(V_{sig} - V_{ref}) = \frac{V_{sig} + V_{ref}}{2}$$

Incidentally, since C1=C2 is assumed in Expression 9, $V_a=(V_{sig}+V_{ref})/2$ is obtained.

The potential which is obtained by subtracting the gate potential $V_{sig}$ of the drive transistor Trd from the potential $V_a$ at the node A is a potential which is held in the capacitor C2. From the results of Expression 9, the voltage $(V_a-V_{sig})$ which is held between the opposite ends of the capacitor C2 is expressed by $(V_{ref}-V_{sig})/2$. Moreover, when the results obtained in Expressions 7 and 8 are substituted into $V_{ref}$ and $V_{sig}$, finally, Expression 10 is obtained:

$$V_a - V_{sig} = \frac{V_{ref} - V_{sig}}{2} = \frac{\sqrt{I_{sig}} - \sqrt{I_{ref}}}{\sqrt{2k\mu}}$$

As apparent from Expression 10, the voltage corresponding to the difference between the signal current $I_{sig}$ and the reference current $I_{ref}$ is held between the opposite ends of the capacitor C2. From the above-mentioned operation, the signal current $I_{sig}$ is written, the current difference between the reference current $I_{ref}$ and the signal current $I_{sig}$ is obtained, and the voltage corresponding to the current difference is expressed as Expression 10 and held in the capacitor C2.

Figure 7:
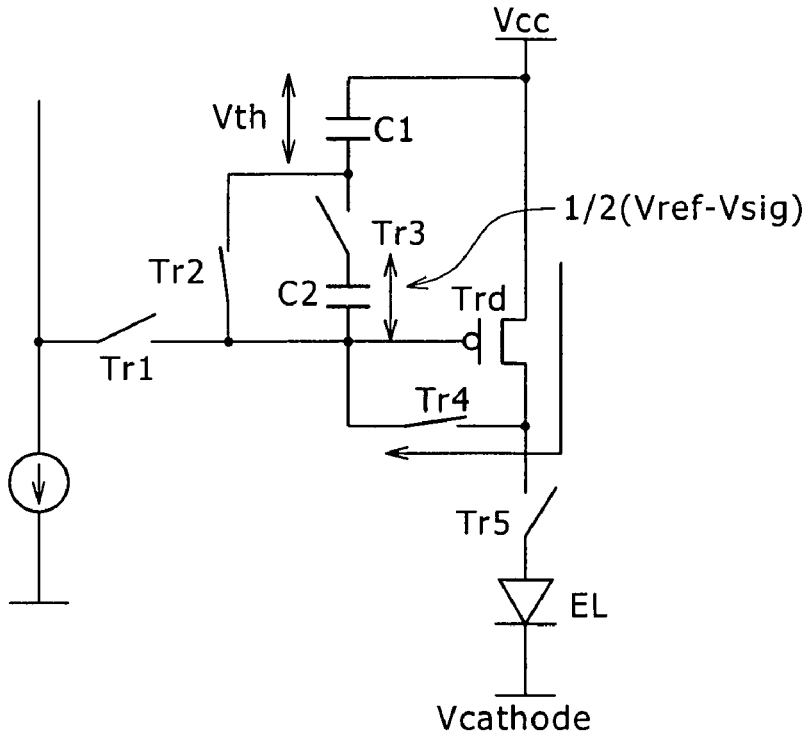
FIG. 7 is a schematic circuit diagram explaining the operation of the pixel circuit shown in FIG. 2.

FIG. 7 is a schematic circuit diagram showing the operation for canceling the threshold voltage $V_{th}$ which is performed for the period T8 to T9 of the timing chart shown in FIG. 4. For the period T8 to T9, the switching transistors Tr3 and Tr5 are in the off state each, while the switching transistors Tr2 and Tr4 are in the on state each. As a result, the power source $V_{cc}$, the drive transistor Trd, the switching transistors Tr4 and Tr2, and the capacitor C1 constitute a closed loop. A current is caused to flow from the power source $V_{cc}$ into the closed loop to charge the capacitor C1 with electricity, thereby making the gate potential of the drive transistor Trd rise. When the gate voltage $V_{gs}$ of the drive transistor Trd reaches exactly the threshold voltage $V_{th}$, no transient current comes to be caused to flow. The gate voltage $V_{gs}$ at this time is written as the threshold voltage $V_{th}$ to the capacitor C1. In such a manner, the potential $V_{th}$ required to cancel the threshold voltage $V_{th}$ of the drive transistor Trd is held in the capacitor C1.

Figure 8:
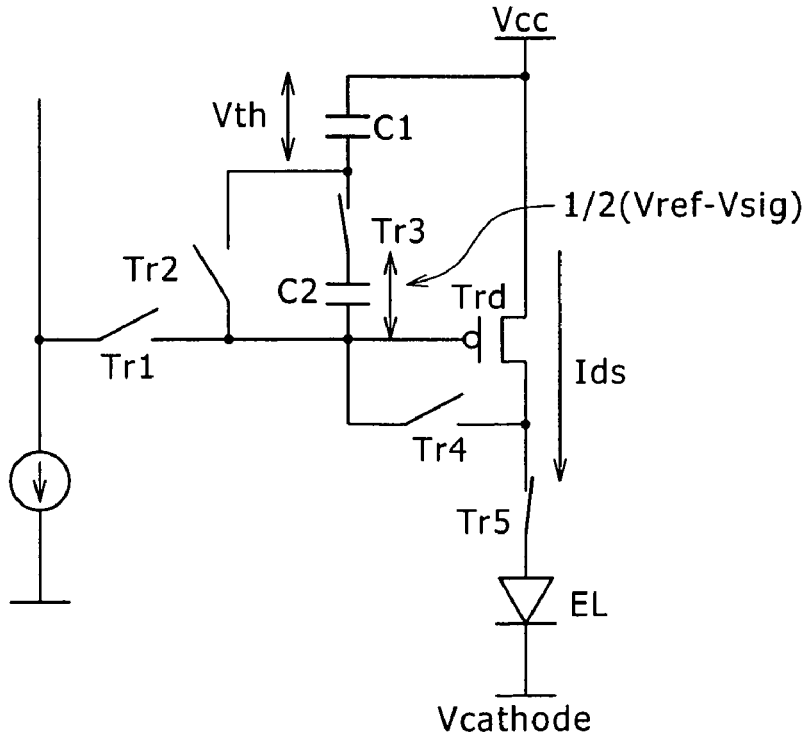
FIG. 8 is a schematic circuit diagram explaining the operation of the pixel circuit shown in FIG. 2.

FIG. 8 is a schematic circuit diagram showing the electroluminescence operation which is performed at and after the timing T11 shown in the timing chart of FIG. 4. As illustrated, for the electroluminescence period at and after the timing T11, the switching transistors Tr1, Tr2 and Tr4 are in the off state each, while the switching transistors Tr3 and Tr5 are in the on state each. As a result, the drive current $I_{ds}$ is caused to flow from the power source $V_{cc}$ into the electroluminescence element EL through the drive transistor Trd and the switching transistor Tr5, so that the electroluminescence element EL emits light at predetermined luminance. The gate voltage $V_{gs}$ of the drive transistor Trd for the electroluminescence period is the sum of the voltage held in the capacitor C1 and the voltage held in the capacitor C2 since the switching transistor Tr3 is in the on state. When the switching transistor Tr3 is turned C1 on in order to connect the capacitors C1 and C2 to each other, the capacitors C1 and C2 are connected to each other while holding therein the electric charges since each of the capacitance values of the capacitors C1 and C2 is larger than a gate parasitic capacity. Thus, the gate voltage $V_{gs}$ of the drive transistor Trd becomes the sum of the voltage $V_{th}$ held in the capacitor C1 and the voltage $(V_{ref}-V_{sig})/2$ held in the capacitor C2, and is expressed by Expression 11:

$$V_{gs} = V_{th} + \frac{1}{2}(V_{ref} - V_{sig})$$

On the other hand, the drive current $I_{ds}$ which is caused to flow for the electroluminescence period is expressed by Expression 12. Incidentally, Expression 12 is identical to Expression 1 showing the basic characteristics of the transistor.

$$I_{ds} = \frac{k\mu}{2}(V_{gs} - V_{th})^2$$

When the results obtained from Expression 11 are substituted into $V_{gs}$ in Expression 12, Expression 13 is obtained:

$$I_{ds} = \frac{1}{2}k\mu\left(V_{th} + \frac{V_{ref} - V_{sig}}{2} - V_{th}\right)^2$$

As apparent from Expression 13, the term of $V_{th}$ in the essential transistor characteristic expression is canceled by the term of $V_{th}$ held in the capacitor C1. As a result, the influence of the dispersion of the threshold voltage $V_{th}$ of the drive transistor Trd is removed. Moreover, when the results obtained from Expression 10 are substituted into the remaining term of $(V_{ref}-V_{sig})/2$ in Expression 13, Expression 14 is obtained:

$$I_{ds} = \frac{1}{2}k\mu\left(\frac{\sqrt{I_{sig}} - \sqrt{I_{ref}}}{\sqrt{2k\mu}}\right)^2$$

Since the term of the mobility μ in Expression 14 is finally canceled between a numerator and a denominator, the drive current $I_{ds}$ is finally expressed by Expression 15:

$$I_{ds} = \frac{1}{4}(\sqrt{I_{sig}} - \sqrt{I_{ref}})^2$$

As apparent from Expression 15, the drive current $I_{ds}$ depends on a difference between the signal current $I_{sig}$ and the reference current $I_{ref}$, and thus the terms of the mobility it and the threshold voltage $V_{th}$ which are inherent in the drive transistor are not contained in Expression 15. In such a manner, in the pixel circuit of the present invention, the electroluminescence current is determined based on the current difference value between the signal current $I_{sig}$ and the reference current $I_{ref}$. Thus, it is possible to obtain the image quality having high uniformity which does not depend on the dispersion in threshold voltage $V_{th}$ and mobility μ. Moreover, in the pixel circuit, the black display is made under the condition of $I_{sig}=I_{ref}$. Also, the values of $I_{ref}$ and $I_{sig}$ are set as the current values enough to perform the write. For this reason, even the signal current corresponding to the black display can be sufficiently written to the pixel capacitor for one horizontal period, and thus the generation of the black embossing and the longitudinal cross-talk can be suppressed.

Figure 9:
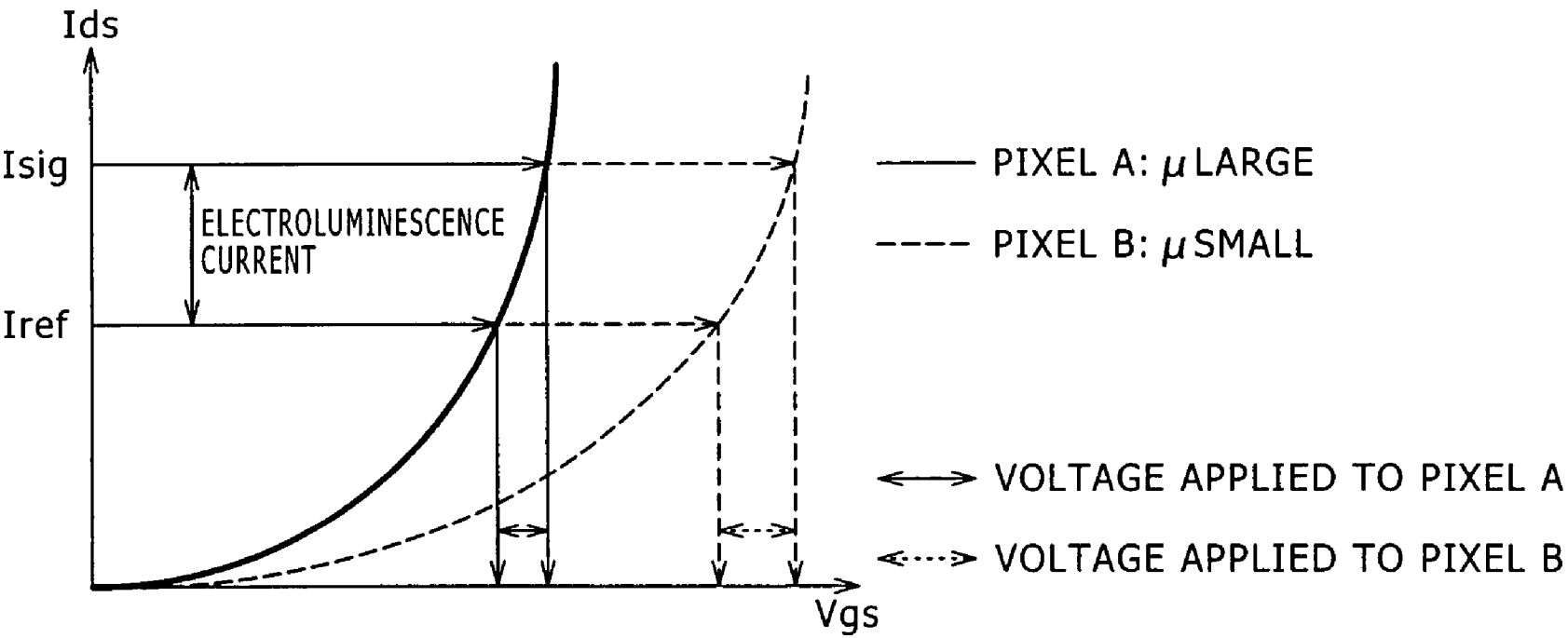
FIG. 9 is a graphical representation showing current vs. voltage characteristics of a drive transistor.

FIG. 9 is a graph schematically showing the operation of the drive transistor included in the pixel circuit according to the present invention. This graph for which an axis of abscissa represents the gate voltage $V_{gs}$ and an axis of ordinate represents a drain current $I_{ds}$ schematically shows the operating characteristics of the drive transistor. A solid line represents the characteristics of the drive transistor included in a pixel A and shows a case of the large mobility μ. A curve indicated by a dotted line represents the characteristics of the drive transistor included in a pixel B and shows a case of the small mobility μ. A slope of the characteristic curve becomes gentle as the mobility μ is smaller, and thus the characteristics disperse between the pixels. Such dispersion in characteristics appears remarkably in the transistor using the low-temperature polysilicon thin film. Even in a case of the drive transistor having dispersion in characteristics, in the present invention, the drive transistor is controlled so that the electroluminescence current is determined depending on the difference between the signal current $I_{sig}$ and the reference current $I_{ref}$. Consequently, the picture image quality having the high uniformity is obtained since the electroluminescence current control corresponding to the current difference is usually performed in each pixel even when the mobility μ disperses.

As described above, the pixel circuit 2 according to this embodiment of the present invention shown in FIG. 2 is disposed in a place where the signal line SL through which the signal current $I_{sig}$ is caused to flow, and the scanning lines WS1, WS2, WS3, AZ and DS through which the control signals are supplied, respectively, cross each other. The pixel circuit 2 is constituted by the electroluminescence element EL, the drive transistor Trd for supplying the drive current $I_{ds}$ to the electroluminescence element EL, and the control portion adapted to operate in accordance with the control signals WS1, WS2, WS3, AZ and DS for controlling the drive current $I_{ds}$ of the drive transistor Trd based on the signal current $I_{sig}$. The control portion includes first sampling means, second sampling means, and difference means. The first sampling means is constituted by the switching transistors Tr1, Tr3 and Tr4, and the pixel capacitor C2, and serves to sample the signal current $I_{sig}$ which is caused to flow through the signal line SL. The second sampling means is constituted by the switching transistors Tr1, Tr2, Tr3 and Tr4, and the pixel capacitor C1 and serves to sample the reference current $I_{ref}$ which is caused to flow through the signal line SL just before or after the signal current $I_{sig}$. The difference means is constituted by the switching transistors Tr1, Tr3 and Tr4, and a pair of pixel capacitors C1 and C2 and serves to generate the control voltage $(V_{ref}-V_{sig})/2$ corresponding to the difference between the sampled signal current $I_{sig}$ and the sampled reference current $I_{ref}$. The drive transistor Trd receives the control voltage $(V_{ref}-V_{sig})/2$ and supplies the drive current $I_{ds}$ which is caused to flow through its source S/drain D to the electroluminescence element EL to make the electroluminescence element EL emit light.

When the relative difference between the signal current $I_{sig}$ and the reference current $I_{ref}$ which are sampled by the first and second sampling means, respectively, is small, an amount of electroluminescence of the electroluminescence element EL becomes little, while when the relative difference between the signal current $I_{sig}$ and the reference current $I_{ref}$ is large, the amount of electroluminescence of the electroluminescence element EL becomes much. However, even when the relative difference is small, the absolute levels of the signal current $I_{sig}$ and the reference current $I_{ref}$ are set as large enough to make the sampling possible.

The control portion of the pixel circuit 2 includes correcting means in addition to the first and second sampling means, and the difference means. The correcting means is constituted by the switching transistors Tr2 and Tr4, and the pixel capacitor C1 and adapted to detect the threshold voltage $V_{th}$ of the drive transistor Trd to add the detected threshold voltage $V_{th}$ to the control voltage $(V_{ref}-V_{sig})/2$. As a result, the influence of the threshold voltage $V_{th}$ can be canceled from the drive current $I_{ds}$ In this embodiment, the first sampling means samples the signal voltage $V_{sig}$ which is generated at the gate G when the signal current $I_{sig}$ is caused to flow through the drive transistor Trd. Likewise, the second sampling means samples the reference voltage $V_{ref}$ which is generated at the gate G when the reference current $I_{ref}$ is caused to flow through the drive transistor Trd. At this time, the difference means couples the signal voltage $V_{sig}$ and the reference voltage $V_{ref}$ to each other through the capacitor C2 to obtain the difference between the signal voltage $V_{sig}$ and the reference voltage $V_{ref}$, thereby generating the control voltage $(V_{ref}-V_{sig})/2$. At that, the first sampling means includes the second capacitor C2 for holding therein the sampled signal voltage $V_{sig}$, and the second sampling means includes the first capacitor C1 for holding therein the sampled reference voltage $V_{ref}$ and for coupling the sampled reference voltage $V_{ref}$ to the signal voltage $V_{sig}$. In this case, the first and second capacitors C1 and C2 have the same capacitance value.

Figure 10:
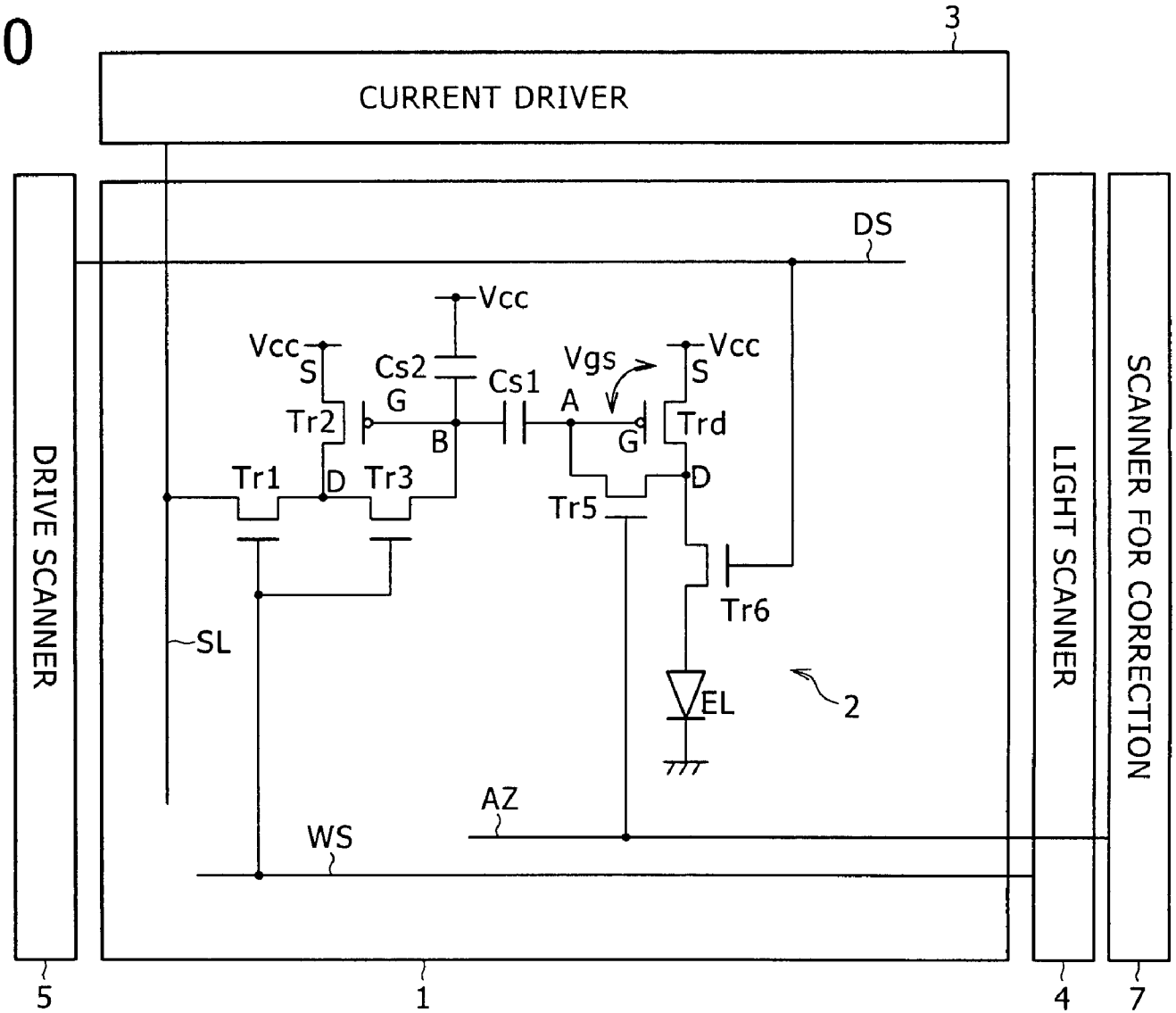
FIG. 10 is a circuit diagram showing a pixel circuit and a display device according to another embodiment of the present invention.

FIG. 10 is a circuit diagram showing a pixel circuit and a display device having the pixel circuit incorporated therein according to another embodiment of the present invention. As shown in the figure, the display device is constituted by a pixel array 1 constituting a main portion and a circuit portion provided in the periphery of the pixel array 1. The peripheral circuit portion is constituted by a current driver 3 constituting a driver portion, and a light scanner 4, a drive scanner 5 and a scanner 7 for correction which constitute a scanner portion. The pixel array 1 has a column-distributed signal line SL. The signal line SL is driven by the current driver 3 and a predetermined reference current and a signal current are alternately caused to flow through the signal line SL. The pixel array 1 also has row-distributed scanning lines WS, DS and AZ. The scanning line WS is connected to the light scanner 4, and a control signal WS for sampling of the signal current and the reference current is supplied to the scanning line WS. The drive scanner 5 is connected to the scanning line DS, and a control signal DS for electroluminescence control is supplied to the scanning line DS. The scanner 7 for correction is connected to the scanning line AZ, and a control signal AZ for the threshold voltage correction is supplied to the scanning line AZ.

The pixel circuits 2 are integrally formed in places where the column-distributed signal lines SL and the row-distributed scanning lines WS, DS and AZ cross each other. For the sake of simplicity of illustration, FIG. 10 shows only one pixel circuit 2. As shown in the figure, the pixel circuit 2 is constituted by six transistors Tr1, Tr2, Tr3, Tr5, Tr6 and Trd, two pixel capacitors Cs1 and Cs2, and one electroluminescence element EL. Of the six transistors Tr1, Tr2, Tr3, Tr5, Tr6 and Trd, the transistors Tr1, Tr3, Tr5 and Tr6 are N-channel thin film transistors. On the other hand, the transistors Tr2 and Trd are P-channel thin film transistors. A pair of P-channel transistors Tr2 and Trd are connected with their gates to each other through the pixel capacitor Cs1, and thus constitute a current mirror circuit. The transistor Tr2 is disposed on an input side of the current mirror circuit, and the transistor Trd is disposed on an output side of the current mirror circuit. The transistor Trd disposed on the output side is a drive transistor for driving the electroluminescence element EL. The electroluminescence element EL is a two-terminal type (diode type) electroluminescence element including an anode and a cathode. For example, an organic EL element can be used as the electroluminescence element EL. A source S of the drive transistor Trd is connected to a power source $V_{cc}$. A drain D of the drive transistor Trd is connected to the anode of the electroluminescence element EL through the transistor Tr6. A cathode of the electroluminescence element EL is grounded. A gate G of the drive transistor Trd is connected to one end of the pixel capacitor Cs1. In the figure, one end of the pixel capacitor Cs1 is indicated by a point A. A source/drain of the transistor Tr5 is connected between the gate G and drain D of the drive transistor Trd. A control pulse AZ is supplied from the scanner 7 for correction to a gate of the transistor Tr5 through the scanning line AZ. In this specification, for the sake of making the understanding and the description easy, the scanning lines and the control signals corresponding thereto are designated with the same reference symbols. A source/drain of the transistor Tr6 is connected between the drain of the drive transistor Trd and the anode of the electroluminescence element EL. A control signal DS for electroluminescence control is supplied from the drive scanner 5 to a gate of the transistor Tr6 through the scanning line DS. The transistor Tr2 constituting the input side of the current mirror circuit is connected with its source S to the power source $V_{cc}$, connected with its drain D to the signal line SL through the transistor Tr1, and connected with its gate G to the other end of the pixel capacity Cs1. In the figure, the other end of the pixel capacitor Cs1 is indicated by a point B. The transistor Tr2 serves as a mirror of the drive transistor Trd, and thus the mobility $\mu$ of the transistor Tr2 is basically equal to that of the drive transistor Trd. A source/drain of the transistor Tr1 is connected between the signal line SL and the drain D of the transistor Tr2, and a gate of the transistor Tr1 receives a control signal WS for signal sampling from the light scanner 4 through the scanning line WS. A source/drain of the transistor Tr3 is connected between the drain D of the transistor Tr2 and the point B, and a gate of the transistor Tr3 is connected to the scanning line WS. The other pixel capacitor Cs2 is connected between the point B and the power source $V_{cc}$.

Figure 11:
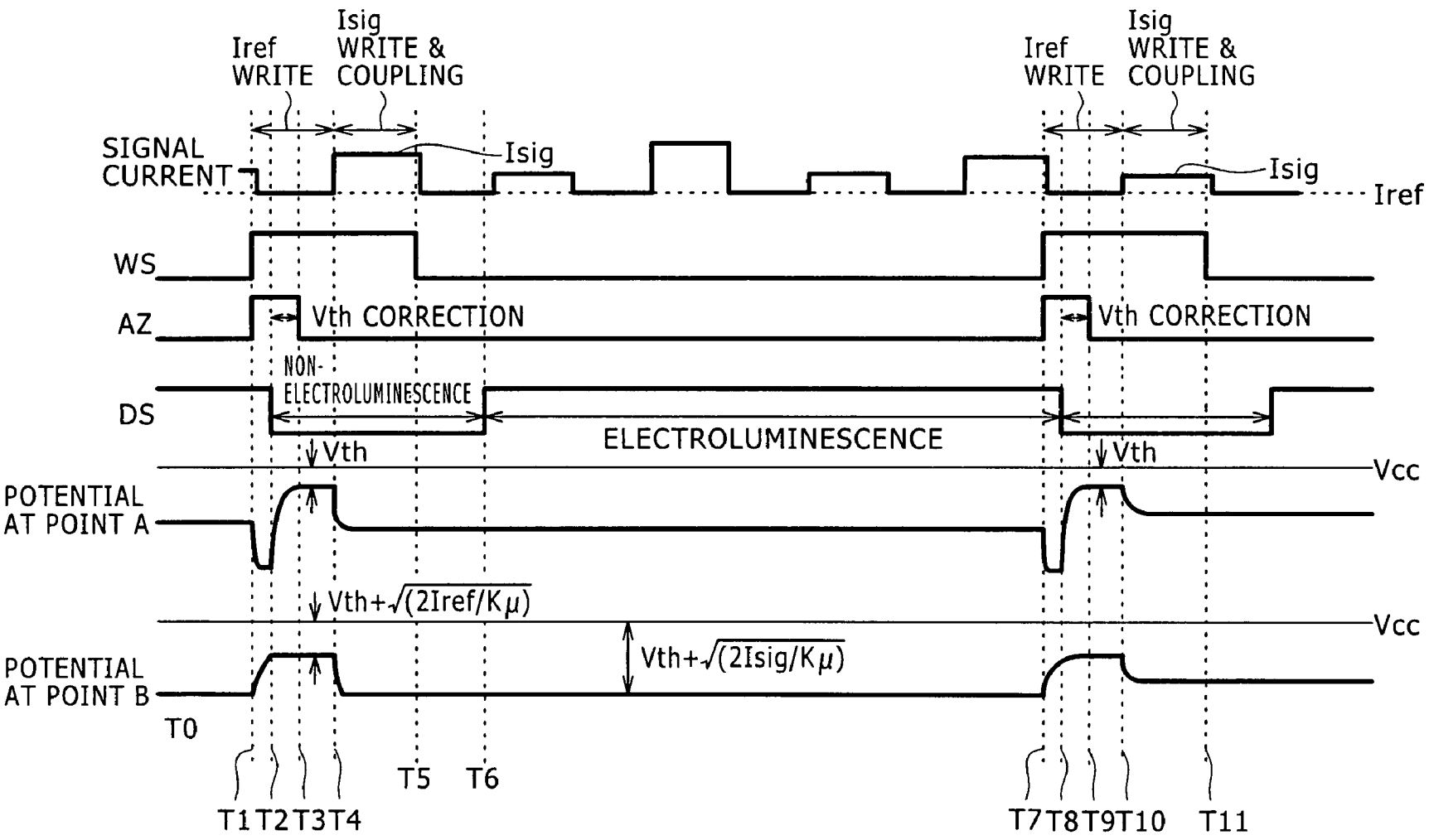
FIG. 11 is a timing chart explaining an operation of the pixel circuit shown in FIG. 10.

FIG. 11 is a timing chart explaining the operation of the pixel circuit shown in FIG. 10. Changes in waveform of the signal current and waveforms of the control signals WS, AZ and DS are shown along a time axis T. Changes in potentials at the points A and B are also shown together with those changes. As previously stated, the point A is the gate G of the drive transistor Trd, disposed on the output side, of a pair of transistors Tr2 and Trd constituting the current mirror circuit. In addition, the point B is the gate G of the mirror transistor Tr2, disposed on the input side, of a pair of transistors Tr2 and Trd. In the timing chart shown in the figure, one field starts at timing T1, and one field ends at timing T7. One picture is displayed with one field. The pictures are continuously displayed on the pixel array by repeating the field operation.

The signal current which is caused to flow through the signal line changes every one horizontal period (1H). For each horizontal period, the predetermined reference current $I_{ref}$ is caused to flow through the signal line SL for the first half, and the signal current $I_{sig}$ is caused to flow through the signal line SL for the second half. The reference current $I_{ref}$ has a fixed level, while the signal current $I_{sig}$ has a level corresponding to the image signal.

At timing T0 before the field concerned starts, the control signals WS and AZ are at a low level each, while the control signal DS is at a high level. Since the control signal DS is at the high level, the switching transistor Tr6 is in an on state and a drive current is supplied from the drive transistor Trd to the electroluminescence element EL. Consequently, at the timing T0, the electroluminescence element EL is in an electroluminescence state.

When the field concerned starts at timing T1, the control signals WS and AZ rise to turn on all the switching transistors Tr1, Tr3, Tr5 and Tr6. At this time, nearly at the same time, the current which is caused to flow through the signal line SL is changed from the signal current $I_{sig}$ over to the reference current ref. As a result, the reference current $I_{ref}$ is caused to flow from the power source $V_{cc}$ into the signal line SL through the input side transistor Tr2 and the switching transistor Tr1.

In response to this, the potential at the point B connected to the gate G of the input side transistor Tr2 rise to a level corresponding to the reference current $I_{ref}$. In other words, the potential corresponding to the reference current $I_{ref}$ is written to the pixel capacitor Cs2. This operation continues up to timing T4. That is, for a period T1 to T4, the reference current $I_{ref}$ is written to the pixel capacitor Cs2.

On the other hand, on the point A side, after at the timing T1, once the current is caused to flow through the drive transistor Trd, at timing T2, the switching transistor Tr6 is turned off. As a result, the gate potential (the potential at the point A) of the drive transistor Trd rises since the current path is cut off. At a time point when the potential at the point A reaches the threshold voltage $V_{th}$ of the drive transistor Trd, the drive transistor Trd is turned off. The threshold voltage $V_{th}$ of the drive transistor Trd is detected in this operation and held in the pixel capacitor Cs1. The held threshold voltage $V_{th}$ will be used to cancel the dispersion in threshold voltage $V_{th}$ of the drive transistor Trd in the later electroluminescence operation. At timing T3 after the drive transistor Trd is turned off, the control signal AZ becomes a low level and the switching transistor Tr5 is turned off. As a result, the threshold voltage $V_{th}$ written to the pixel capacitor Cs1 is fixed. The processing for detecting and holding the threshold voltage $V_{th}$ of the drive transistor Trd in such a manner is executed for a period from the timing T2 to the timing T3. In this specification, this period T2 to T3 is referred to as a $V_{th}$ correcting period or a $V_{th}$ canceling period. As apparent from the above description, for a period T1 to T4, the reference current $I_{ref}$ written on the input transistor Tr2 side of the current mirror circuit, while the threshold voltage $V_{th}$ is canceled on the output transistor Trd side of the current mirror circuit.

At the timing T4, the current which is caused to flow through the signal line SL is changed from the reference current $I_{ref}$ over to the signal current $I_{sig}$. As a result, the signal current $I_{sig}$ is caused to flow through the input side transistor Tr2 in a direction from the power source $V_{cc}$ toward the signal line SL. Thus, the potential at the point B changes from the level corresponding to the previous reference current $I_{ref}$ to the level corresponding to the signal current $I_{sig}$. This change is coupled to the point A side through the pixel capacitor Cs1 based on the current mirror operation. Thereafter, at timing T5, the control signal WS becomes the low level, and the switching transistors Tr1 and Tr3 are turned off. In such a manner, for the period T4 to T5, the signal current $I_{sig}$ is sampled and the potential change corresponding to the difference between the reference current $I_{ref}$ and the signal current $I_{sig}$ is coupled from the point B side to the point A side.

When the operation proceeds to timing T6, the control signal DS becomes the high level again and the switching transistor Tr6 is turned on. As a result, the drive transistor Trd and the electroluminescence element EL are directly connected to each other, the drive current $I_{ds}$ is supplied from the drive transistor Trd to the electroluminescence element EL, and thus the electroluminescence element EL becomes an electroluminescence state. At this time, the drive current $I_{ds}$ supplied from the drive transistor Trd becomes one corresponding to the potential written to the point A. As previously described, the potential at the point A corresponds to the difference between the reference current $I_{ref}$ and the signal current $I_{sig}$.

Thereafter, when the operation proceeds to timing T7, the field concerned ends and a next field starts. Similarly to the last field, at the timing T7, the reference current $I_{ref}$ starts to be written, and at next timing T8, the operation for canceling the threshold voltage $V_{th}$ starts.

Figure 12:
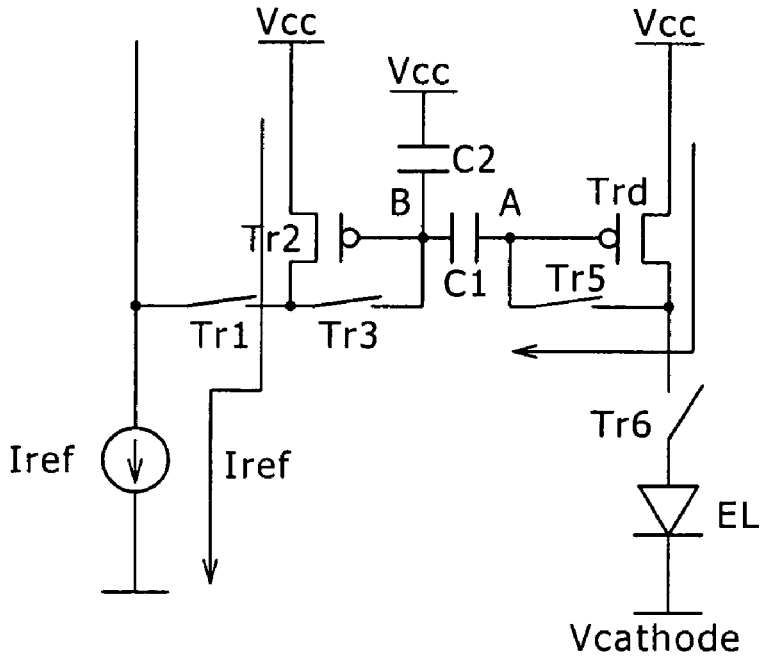
FIG. 12 is a schematic circuit diagram explaining the operation of the pixel circuit shown in FIG. 10.

FIG. 12 is a schematic circuit diagram showing the reference current $I_{ref}$ writing operation and the threshold voltage $V_{th}$ correcting operation which are performed for the period T1 to T4 shown in the timing chart of FIG. 11. For the sake of making the understanding easy, in this schematic circuit diagram, the switching transistors Tr1, Tr3, Tr5 and Tr6 are replaced in illustration with switching symbols, respectively, and the pixel capacitors Cs1 and Cs2 are expressed in illustration by capacitance value C1 and C2, respectively. The operation for correcting the threshold voltage $V_{th}$ is performed on the output side of the pixel circuit having the current mirror structure. That is, the state of the transistor Tr6 is changed from the on state to the off state, whereby the current path for the drive transistor Trd is cut off and the pixel capacitor C1 starts to be charged with electricity through the switching transistor Tr5. When the charging makes the potential at the point A rise up to the threshold voltage $V_{th}$ of the drive transistor Trd, the drive transistor Trd is turned off. Thereafter, turning off the switching transistor Tr5 fixes the threshold voltage $V_{th}$ held in the pixel capacitor C1.

On the other hand, the operation for writing the reference current $I_{ref}$ is performed on the input side of the current mirror circuit. Since the switching transistors Tr1 and Tr3 are in the on state, the reference current $I_{ref}$ is caused to flow from the power source $V_{cc}$ into the signal line SL through the input side transistor Tr2 and the switching transistor Tr1. At this time, the potential developed at the point B connected to the gate G of the input-side transistor Tr2 is assigned $V_{ref}$. The potential $V_{ref}$ has a level corresponding to the reference current $I_{ref}$. The gate voltage $V_{gs}$ developed across the source S and gate G of the input side transistor Tr2 is expressed by $(V_{cc}-V_{ref})$. Here, the input side transistor Tr2 operates in the saturated region since the switching transistor Tr3 is in the on state, and thus a relationship between the drain current $I_{ref}$ and the gate voltage $V_{gs}$ is expressed by Expression 16:

$$I_{ref} = \frac{k\mu}{2}(V_{gs} - V_{th})^2 = \frac{k\mu}{2}(V_{cc} - V_{ref} - V_{th})^2$$

In Expression 16, $V_{gs}$ is replaced with $(V_{cc}-V_{ref})$. Consequently, Expression 16 represents the relationship between the reference current $I_{ref}$ and the potential $V_{ref}$ at the point B.

Rearranging Expression 16 for $V_{ref}$, Expression 17 is obtained:

$$V_{ref} = V_{cc} - V_{th} - \sqrt{\frac{2I_{ref}}{k\mu}}$$

As apparent from Expression 17, the potential $V_{ref}$ at the point B is a function of the reference current $I_{ref}$. Incidentally, in Expression 17, μ represents mobility of the input side transistor Tr2, k represents a size of the input side transistor Tr2, and $V_{th}$ represents a threshold voltage of the input side transistor Tr2.

Figure 13:
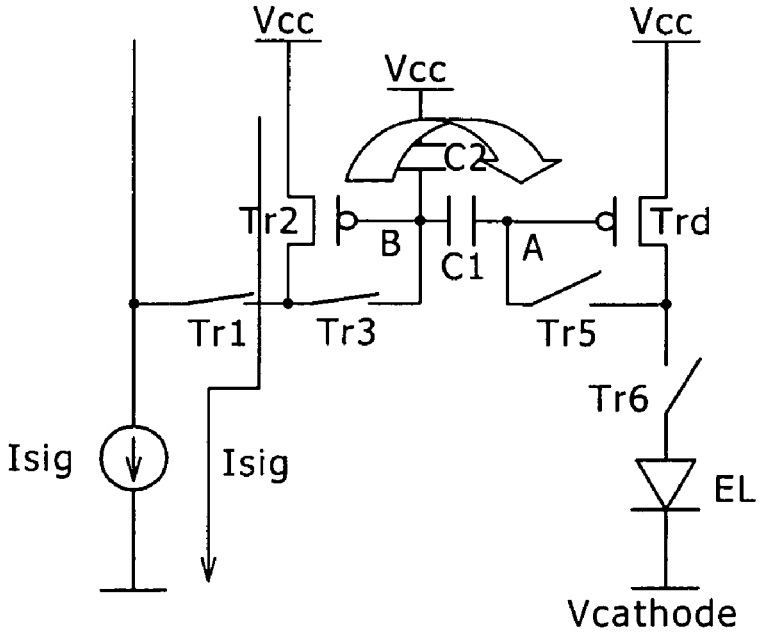
FIG. 13 is a schematic circuit diagram explaining the operation of the pixel circuit shown in FIG. 10.

FIG. 13 is a schematic diagram showing the signal current $I_{sig}$ writing operation and the coupling operation which are performed for the period T4 to T5 in the timing chart shown in FIG. 11. For the period T4 to T5, the switching transistors Tr5 and Tr6 are in the off state, and the current which is caused to flow through the signal line SL is changed from the reference current $I_{ref}$ over to the signal current $I_{sig}$. As a result, the signal current $I_{sig}$ is caused to flow from the power source $V_{cc}$ into the signal line SL through the input side transistor Tr2 and the switching transistor Tr1. In other words, the signal current $I_{sig}$ becomes a drain current which is caused to flow through the input-side transistor Tr2. The drain current is caused to flow through the input side transistor Tr2, whereby the potential at the point B changes from the previous reference potential $V_{ref}$ to the potential $V_{sig}$. The potential $V_{sig}$ at the point B is expressed by Expression 18 based on the same calculation as that for Expression 17 expressing the reference voltage $$V_{ref}:V_{sig} = V_{cc} - V_{th} - \sqrt{\frac{2I_{sig}}{k\mu}}$$

As apparent from Expression 18, the potential $V_{sig}$ at the point B is a function of the signal current $I_{sig}$.

A potential change developed at the point B is expressed by $\Delta V_b = V_{sig} - V_{ref}$. When this relationship is substituted into Expressions 17 and 18, Expression 19 is obtained:

$$\Delta V_b = \sqrt{\frac{2}{k\mu}}\left(\sqrt{I_{ref}} - \sqrt{I_{sig}}\right)$$

As apparent from Expression 19, the potential change $\Delta V_b$ at the point B is expressed by a difference between the square root of the reference current $I_{ref}$ and the square root of the signal current $I_{sig}$.

The potential change $\Delta V_b$ at the point B is coupled to the point A side based on the current mirror operation through the pixel capacitor C1. An amount of coupling is determined based on the capacitance division of the pixel capacitance C1 and a gate capacity Cg of the drive transistor Trd. Consequently, the potential change $\Delta V_a$ at the point A is expressed by Expression 20:

$$\Delta V_a = \frac{C1}{C1 + Cg}\Delta V_b$$

When Expression 19 is substituted into $\Delta V_b$ in Expression 20, finally, the potential change $\Delta V_a$ at the point A is expressed by Expression 21:

$$\Delta V_a = \frac{C1}{C1 + Cg}\sqrt{\frac{2}{k\mu}}\left(\sqrt{I_{ref}} - \sqrt{I_{sig}}\right)$$

In Expression 21, the pixel capacitance C1 is larger than the gate capacity Cg of the drive transistor Trd. Consequently, a coefficient C1/(C1+Cg) in a right member of Expression 21 takes a value near 1. In other words, the potential change $\Delta V_b$ on the output side of the current mirror circuit is mirrored in the potential change $\Delta V_a$ on the output side nearly as it is.

Figure 14:
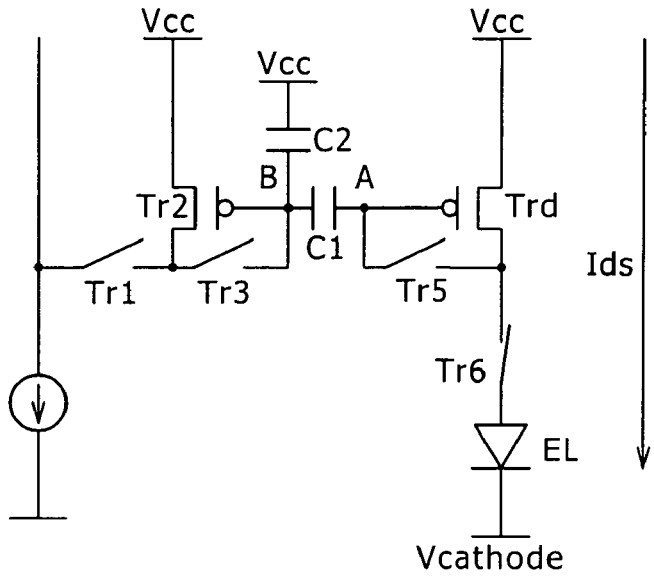
FIG. 14 is a schematic circuit diagram explaining the operation of the pixel circuit shown in FIG. 10.

FIG. 14 is a schematic circuit diagram showing the electroluminescence operation which is performed for the period T6 to T8 of the timing chart shown in FIG. 11. For the electroluminescence period, the switching transistors Tr1, Tr3 and Tr5 are in the off state, while the switching transistor Tr6 is in the on state. As a result, the drive transistor Trd and the electroluminescence element EL are directly connected to each other and thus the drive current $I_{ds}$ is caused to flow through the electroluminescence element EL, so that the electroluminescence element EL emits light. The drive current $I_{ds}$ caused to flow through the electroluminescence element EL is regulated by the gate voltage $V_{gs}$ of the drive transistor Trd. The gate voltage $V_{gs}$ is obtained by subtracting the potential $V_a$ at the point A from the power source potential $V_{cc}$. The potential $V_a$ at the point A is obtained by adding the potential change $\Delta V_a$ obtained from Expression 21 to the potential $(V_{cc}-V_{th})$ written in the $V_{th}$ canceling operation. Consequently, a relationship of $V_a = V_{cc} - V_{th} + \Delta V_a$ is obtained. When the gate voltage $V_{gs}$ obtained in such a manner is substituted into the basic characteristic expression of the transistor expressed by Expression 1, the drive current $I_{ds}$ is expressed by Expression 22:

$$I_{ds} = \frac{1}{2}k'\mu\{V_{cc} - (V_{cc} - V_{th} + \Delta V_a) - V_{th}\}^2$$

$$\left(\frac{C1}{C1 + Cg}\right)^2 \frac{k'}{k}\left(\sqrt{I_{sig}} - \sqrt{I_{ref}}\right)^2$$

In Expression 22, μ represents the mobility of the drive transistor Trd. This mobility μ is identical to the mobility μ of the switching transistor Tr2 as the other of a pair of transistors Tr2 and Trd. In addition, k' represents the size factor of the drive transistor Trd. Rearranging Expression 22, finally, the drive current $I_{ds}$ takes a value corresponding to a difference between the signal current $I_{sig}$ and the reference current $I_{ref}$, and thus the influence of the threshold voltage $V_{th}$ and the mobility μ is canceled. Also, it is understood that the term of $V_{th}$ and the term of μ are not contained in the drive current $I_{ds}$ expressed by Expression 22. As a result, in the pixel circuit according to the present invention, it is possible to obtain the image quality which has the high uniformity and which does not depend on the dispersion in threshold voltage $V_{th}$ and mobility μ. In addition, the value of the drive current $I_{ds}$ depends on a ratio of k to k', i.e., the size ratio of a pair of transistors Tr2 and Trd. Moreover, in the pixel circuit of the present invention, the black display is obtained by setting the signal current $I_{sig}$ as equal to the reference current $I_{ref}$. As apparent from Expression 22, when $I_{sig} = I_{ref}$, a relationship of $I_{ds} = 0$ is obtained. Thus, the perfect black display is obtained since no drive current is caused to flow through the electroluminescence element EL. Even in case of the black display, the absolute values of the signal current $I_{sig}$ and the reference current $I_{ref}$ are set as the current values enough to perform the write. For this reason, even the black signal can be sufficiently written for one horizontal period (1H), and thus the generation of the black embossing, the longitudinal cross-talk, etc. can be suppressed. Incidentally, while in the pixel circuit, the N-channel transistors are used as the switching transistors Tr1, Tr3, Tr5 and Tr6 other than the drive transistor Trd and the mirror transistor Tr2, the present invention is not limited thereto, and thus P-channel transistors may be used. Alternatively, the N-channel transistors and the P-channel transistors may be mixedly used.

As apparent from the above description, the pixel circuit 2 of the present invention is disposed in a place where the signal line SL through which the signal current $I_{sig}$ is caused to flow, and the scanning lines WS, DS and AZ through which the control signals are supplied, respectively, cross each other. The pixel circuit 2 is constituted by the electroluminescence element EL, the drive transistor Trd for supplying the drive current $I_{ds}$ to the electroluminescence element EL, and the control portion adapted to operate in accordance with the control signals WS, AZ and DS for controlling the drive current $I_{ds}$ of the drive transistor Trd based on the signal current $I_{sig}$. The control portion basically includes the first sampling means, the second sampling means, and the difference means. The first sampling means is constituted by the switching transistors Tr1 and Tr3, the pixel capacitor C2, and the mirror transistor Tr2, and serves to sample the signal current $I_{sig}$ which is caused to flow through the signal line SL. The second sampling means is constituted by the switching transistors Tr1 and Tr3, the pixel capacitor C2, and the mirror transistor Tr2, and serves to sample the predetermined reference current $I_{ref}$ which is caused to flow through the signal line SL just before or after the signal current $I_{sig}$. The difference means includes the pixel capacitor C1 and serves to generate the control voltage corresponding to the difference between the sampled signal current $I_{sig}$ and the sampled reference current $I_{ref}$. The drive transistor Trd receives that control signal at its gate G, and supplies the drive current $I_{ds}$ which is caused to flow through its source S/drain D to the electroluminescence element EL to make the electroluminescence element EL emit light.

Figure 15:
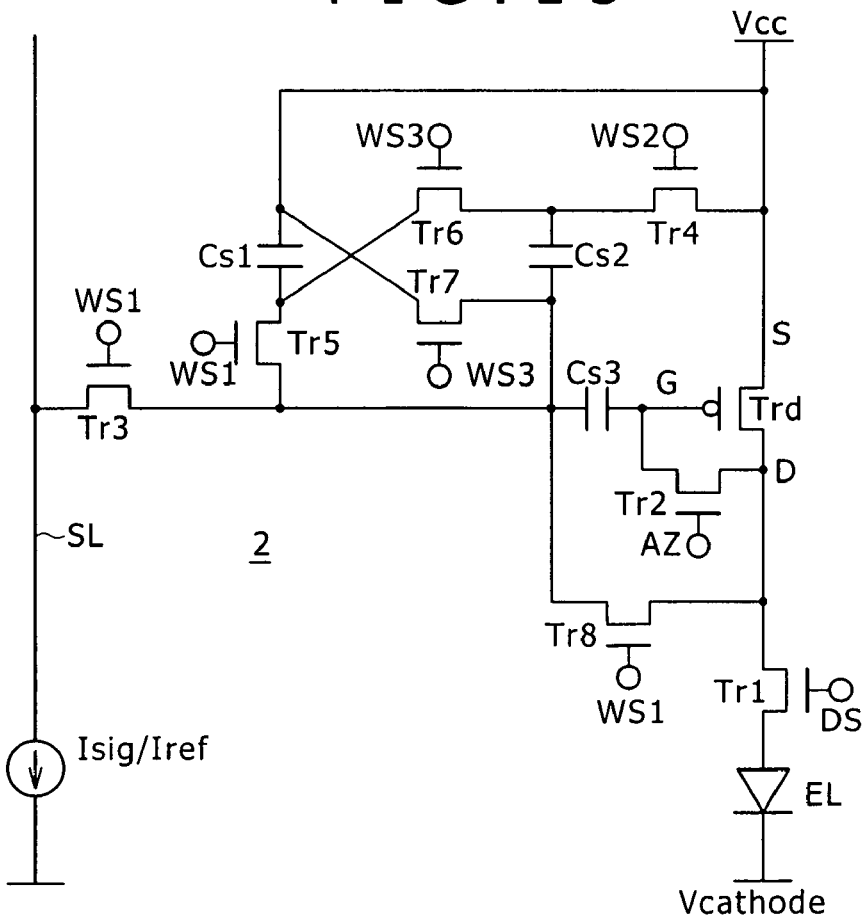
FIG. 15 is a circuit diagram showing a pixel circuit according to still another embodiment of the present invention.

FIG. 15 is a schematic circuit diagram showing a pixel circuit according to still another embodiment of the present invention. A pixel circuit 2 is disposed in a place where a column-distributed signal line SL, and row-distributed signal lines WS1, WS2, WS3, AZ and DS cross each other. A signal current $I_{sig}$ is caused to flow from a current driver (not shown) into the signal line SL just before or after a reference current $I_{ref}$. Control signals WS1, WS2, WS3, AZ and DS are supplied from corresponding scanners to the scanning lines WS1, WS2, WS3, AZ and DS, respectively. In this specification, for the sake of simplification of the description, the scanning lines and the control signals corresponding thereto are designated with the same reference symbols.

The pixel circuit 2 is constituted by eight switching transistors Tr1 to Tr8, one drive transistor Trd, three pixel capacitors Cs1 to Cs3, and an electroluminescence element EL. All the switching transistors Tr1 to Tr8 are N-channel thin film transistors. The drive transistor Trd is a P-channel thin film transistor. The electroluminescence element EL is a two-terminal type (diode type) electroluminescence element including an anode and a cathode. For example, an organic EL element can be used as the electroluminescence element EL. At that, while in this embodiment, all the switching transistors Tr1 to Tr8 are of the N-channel type each, all the switching transistors Tr1 to Tr8 may be of a P-channel type each, or the N-channel thin film transistors and the P-channel thin film transistors may be mixedly used.

The drive transistor Trd is connected with its source S to a power source $V_{cc}$, connected with its drain D to the anode side of the electroluminescence element EL through the switching transistor Tr1, and connected with its gate G to one end of the pixel capacitor Cs3. The control signal DS is applied from the scanning line DS to a gate of the switching transistor Tr1 interposed between the drive transistor Trd and the electroluminescence element EL. The switching transistor Tr2 is connected between the gate G and drain D of the drive transistor Trd. A gate of the switching transistor Tr2 is connected to the scanning line AZ.

A source/drain of the switching transistor Tr3 is connected between the signal line SL and the other end of the pixel capacitor Cs3. A gate of the switching transistor Tr3 is connected to the scanning line WS1. The switching transistor Tr5 is connected between the other end of the pixel capacitor Cs3 and one end of the pixel capacitor Cs1. A gate of the switching transistor Tr5, similarly to the switching transistor Tr3, is connected to the scanning line WS1. The other end of the pixel capacitor Cs1 is connected to the power source $V_{cc}$. The switching transistor Tr4 is connected between the power source $V_{cc}$ and one end of the pixel capacitor Cs2. A gate of the switching transistor Tr4 is connected to the scanning line WS2. The other end of the pixel capacitor Cs2 is connected to the other end of the pixel capacitor Cs3. The switching transistor Tr6 is connected between one end of the pixel capacitor Cs1 and one end of the pixel capacitor Cs2. A gate of the switching transistor Tr6 is connected to the scanning line WS3. In addition, the switching transistor Tr7 is connected between the other end of the pixel capacitor Cs1 and the other end of the pixel capacitor Cs2. A gate of the switching transistor Tr7, similarly to the switching transistor Tr6, is connected to the scanning line WS3. Finally, the switching transistor Tr8 is connected between the drain D of the drive transistor Trd and the other end of the pixel capacitor Cs3. A gate of the switching transistor Tr8, similarly to the switching transistors Tr3 and Tr5, is connected to the scanning line WS1.

Figure 16:
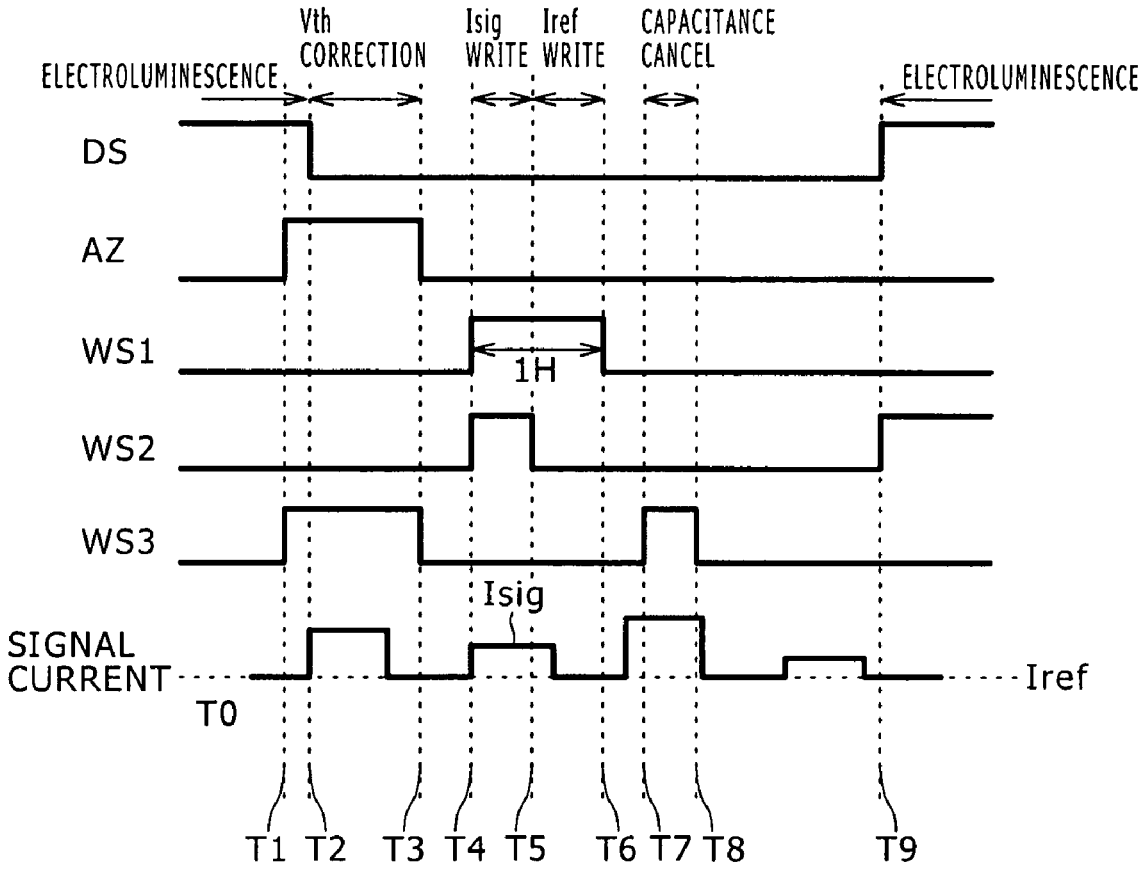
FIG. 16 is a timing chart explaining an operation of the pixel circuit shown in FIG. 15.

FIG. 16 is a timing chart explaining an operation of the pixel circuit 2 shown in FIG. 15. Changes in waveforms of the control signals DS, AZ, WS1, WS2 and WS3 are shown along a time axis T. At the same time, a change in waveform of the signal current $I_{sig}$ is also shown. The signal level of the signal current $I_{sig}$ changes every one horizontal period (1H). In addition, after the signal current $I_{sig}$ is caused to flow through the signal line SL for the first half of each horizontal period, the predetermined reference current $I_{ref}$ is caused to flow through the signal line SL instead for the second half of each horizontal period. The reference current $I_{ref}$ is fixed, while the signal current $I_{sig}$ changes in correspondence to the image signal. This display device writes information on one picture for one field to the pixel array. In the timing chart of FIG. 16, the illustration is made so that one field starts with timing T1.

For a period T0 before the timing T1 at which the field concerned starts, the control signal DS is at a high level, while all the remaining control signals AZ, WS1, WS2 and WS3 are at a low level each. Since the control signal DS is at the high level, the switching transistor Tr1 is in an on state, and the electroluminescence element EL is driven by the drive transistor Trd and thus is in an electroluminescence state.

When the field concerned starts at the timing T1, the control signals AZ and WS3 change from a low level over to a high level each. As a result, the operation enters a preparation state in which the threshold voltage $V_{th}$ of the drive transistor Trd is detected. Subsequently, at timing T2, the control signal DS changes from a high level over to a low level, a state of the electroluminescence element EL is changed from an electroluminescence state over to a non-electroluminescence state, and the threshold voltage $V_{th}$ of the drive transistor Trd is detected. Subsequently, at timing T3, the control signals AZ and WS3 become the low level each and thus the detected threshold voltage $V_{th}$ is held and fixed. The held and fixed threshold voltage $V_{th}$ will be used to cancel or correct the dispersion in threshold voltage $V_{th}$ of the drive transistor Trd in a later electroluminescence stage. Then, a period T2 to T3 is referred to as a $V_{th}$ correcting period in some cases.

At timing T4, the control signals WS1 and WS2 change from a low level over to a high level each. At this time, the signal current $I_{sig}$ is caused to flow through the signal line SL. The signal current $I_{sig}$ is sampled to be written to the pixel circuit 2. Subsequently, when at timing T5, the control signal WS2 changes from the high level over to the low level, the operation for writing the signal current $I_{sig}$ is completed. A period from the timing T4 to the timing T5 for which the signal current $I_{sig}$ is sampled is referred to as an $I_{sig}$ writing period in some cases.

Subsequently, when the current which is caused to flow through the signal line SL is changed from the signal current $I_{sig}$ over to the reference current $I_{ref}$ after the timing T5, the reference current $I_{ref}$ is sampled. When at timing T6, the control signal WS1 returns back to the low level, the operation for writing the reference current $I_{ref}$ is completed. A period T5 to T6 from the timing T5 to the timing T6 is referred to as an $I_{ref}$ writing period. As apparent from the above description, for the period from the timing T5 to the timing T6 for which the control signal WS1 is at the high level, the operation for writing the signal current $I_{sig}$ and the operation for writing the reference current $I_{ref}$ are successively performed. The period T4 to T6 for which the control signal WS1 is at the high level is just one horizontal period (1H). For the one horizontal period 1H allocated to the pixel circuit 2 concerned, the signal current $I_{sig}$ and the reference current $I_{ref}$ can be successively sampled.

Thereafter, the control signal WS3 rises at timing T7, and the control signal WS3 falls at timing T8. For a period T7 to T8 for which the control signal WS3 is at the high level, a difference between the signal current $I_{sig}$ and the reference current $I_{ref}$ is obtained. This difference is obtained based on the operation for canceling the capacitances of the pixel capacitors Cs1 and Cs2. Thus, the period T7 to T8 is referred to as a capacitance canceling period in some cases.

At timing T9, the control signal DS changes from the low level to the high level and the control signal WS2 also changes from the low level to the high level. As a result, the pixel capacitors Cs2 and Cs3 are coupled to each other, and the drive current $I_{ds}$ is supplied from the drive transistor Trd to the electroluminescence element EL, and the electroluminescence element EL performs the electroluminescence operation.

Figure 17:
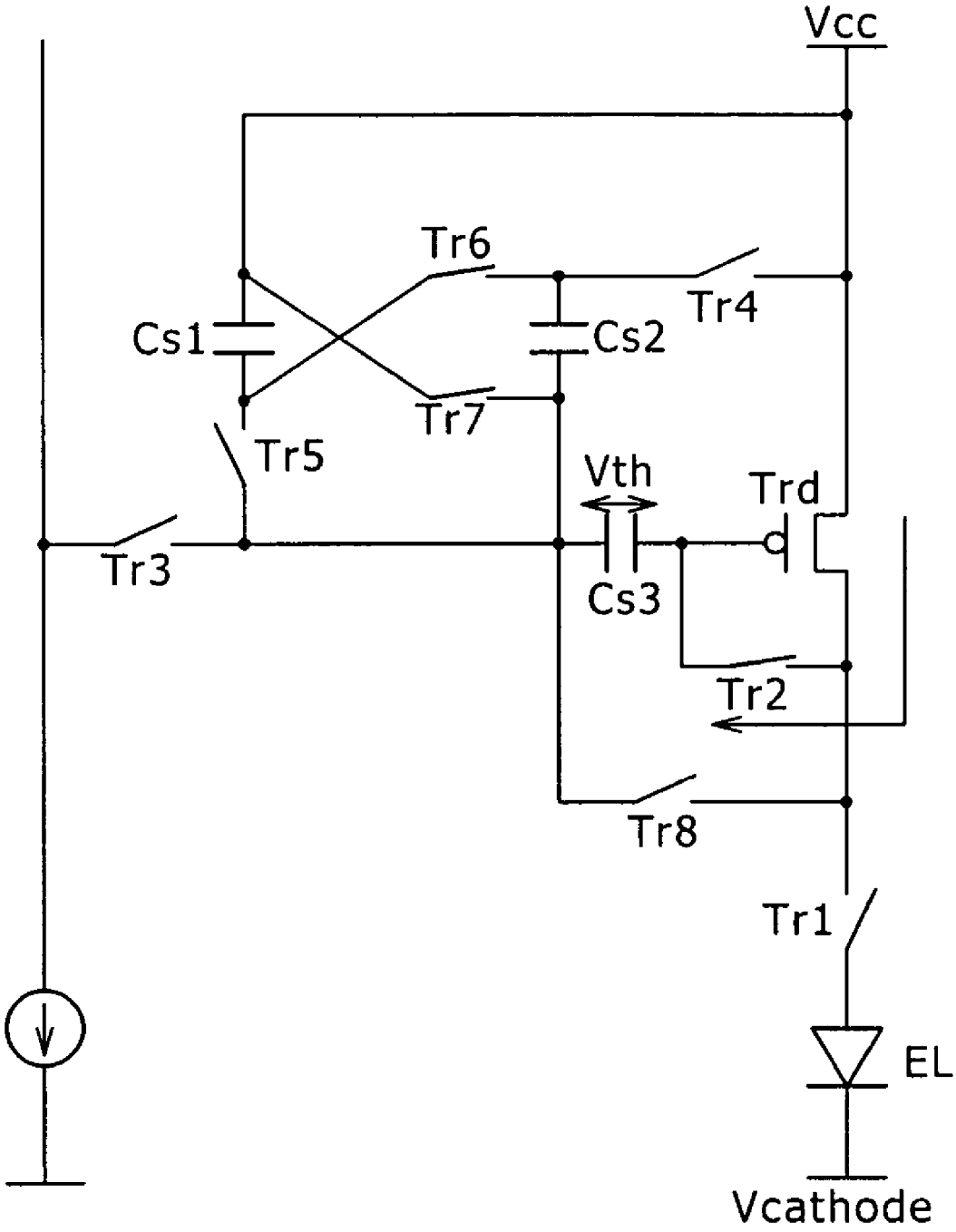
FIG. 17 is a schematic circuit diagram explaining the operation of the pixel circuit shown in FIG. 15.

FIG. 17 is a schematic circuit diagram showing the $V_{th}$ canceling operation which is performed for the $V_{th}$ correcting period T2 to T3 shown in FIG. 16. For the period T2 to T3, the switching transistors Tr1, Tr3, Tr4, Tr5 and Tr8 are in the off state each, while the switching transistors Tr2, Tr6 and Tr7 are in the on state each. As a result, one end of the pixel capacitor Cs3 is connected to the gate of the drive transistor Trd, while the other end of the pixel capacitor Cs3 is connected to the power source $V_{cc}$ through the switching transistor Tr7. When the switching transistor Tr1 is turned off in a state in which the current is caused to flow from the power source $V_{cc}$ toward the electroluminescence element EL, the pixel capacitor Cs3 is charged with electricity through the switching transistor Tr2 since the current path is cut off. Along with the charging, the gate potential of the drive transistor Trd continues to rise. At a time point when the gate potential just reaches the threshold voltage $V_{th}$ of the drive transistor Trd, the drive transistor Trd is turned off. The threshold voltage $V_{th}$ of the drive transistor Trd which is detected at this time point is held between the opposite ends of the pixel capacitor Cs3. Thereafter, the switching transistor Tr2 is turned off and the threshold voltage $V_{th}$ held in the pixel capacitor Cs3 is fixed. The threshold voltage $V_{th}$ which is held and fixed in such a manner will be used to cancel or correct the dispersion in threshold voltage $V_{th}$ of the drive transistor Trd in the later electroluminescence operation.

Figure 18:
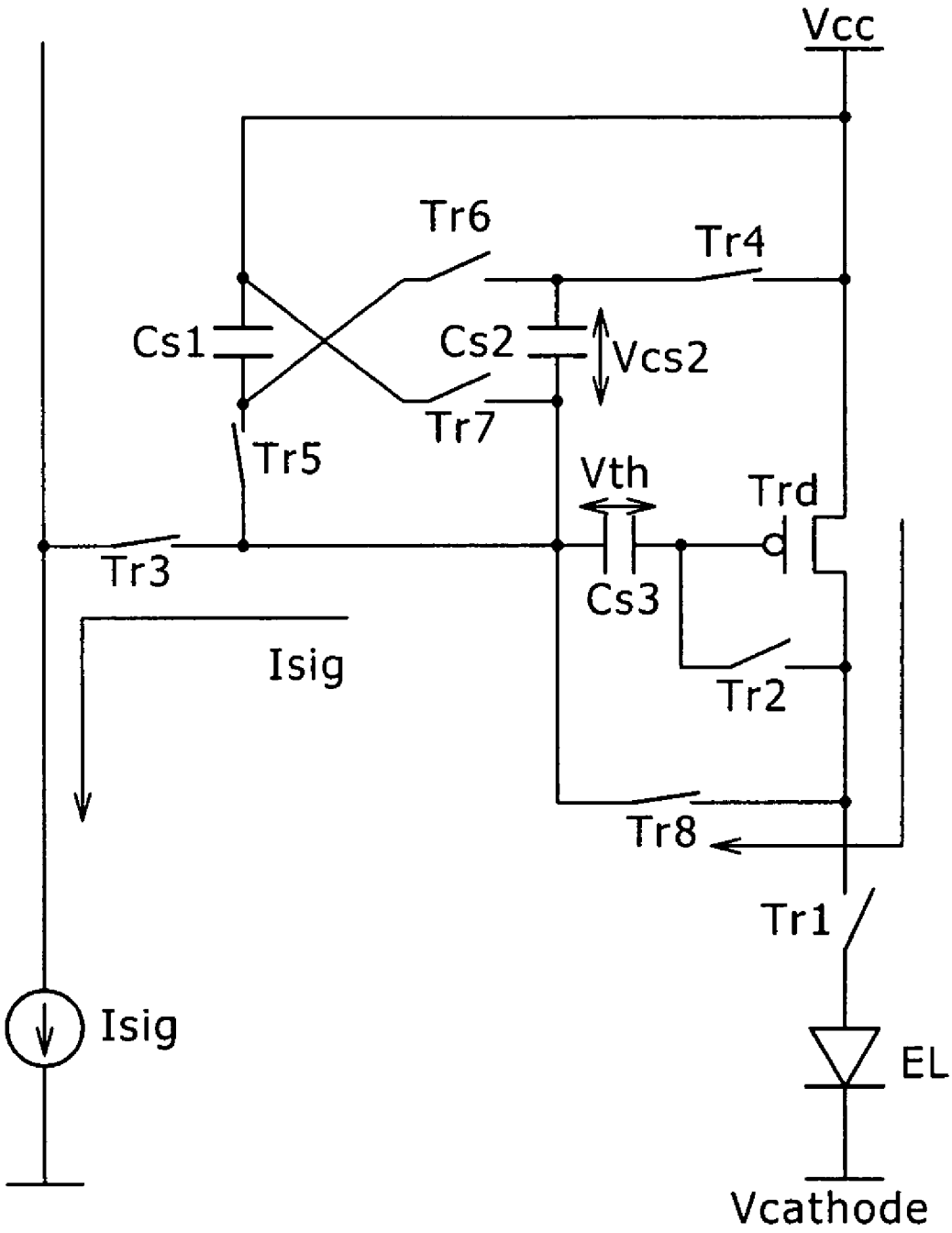
FIG. 18 is a schematic circuit diagram explaining the operation of the pixel circuit shown in FIG. 15.

FIG. 18 is a schematic circuit diagram showing the $I_{sig}$ writing operation which is performed for the period T4 to T5 shown in the timing chart of FIG. 16. For the period T4 to T5, the signal current $I_{sig}$ is being caused to flow through the signal line SL. In addition, the switching transistors Tr1, Tr2, Tr6 and Tr7 are in the off state, while the switching transistors Tr3, Tr4, Tr5 and Tr8 are in the on state. As a result, the signal current $I_{sig}$ is caused to flow from the power source $V_{cc}$ into the signal line SL side through the drive transistor Trd, and the switching transistors Tr8 and Tr3. In other words, the signal current $I_{sig}$ is caused to flow as the drain current through the drive transistor Trd. Consequently, the drain current $I_{sig}$ is expressed in accordance with the basic characteristics of the transistor shown in Expression 1 by Expression 23:

$$I_{sig} = \frac{k\mu}{2}(V_{gs} - V_{th})^2$$

where $V_{gs}$ represents the gate voltage developed across the gate and source of the drive transistor Trd, $V_{th}$ represents the threshold voltage of the drive transistor Trd, k represents the size factor of the drive transistor Trd, and μ represents the mobility of the drive transistor Trd.

Here, rearranging Expression 23 for $V_{gs}$, Expression 24 is obtained:

$$V_{gs} = \sqrt{\frac{2I_{sig}}{k\mu}} + V_{th}$$

Here, referring to FIG. 18, the pixel capacitors Cs2 and Cs3 are connected in series between the source and gate of the drive transistor Trd. When the voltage held between the opposite ends of the pixel capacitor Cs2 is assigned $V_{cs2}$, and the voltage held in the pixel capacitor Cs3 is assigned Vcs3, the gate voltage $V_{gs}$ is given by $V_{gs}=V_{cs2}+V_{cs3}$. Here, Vcs3 is set to $V_{th}$ through the previous $V_{th}$ canceling operation. Thus, a relationship of $V_{gs}=V_{cs2}+V_{th}$ is obtained. When $V_{gs}$ given by Expression 24 is substituted into $V_{gs}$ in that expression to rearrange that expression, the voltage $V_{cs2}$ held in the pixel capacitor Cs2 is given by Expression 25:

$$V_{cs2} = \sqrt{\frac{2I_{sig}}{k\mu}}$$

As apparent from Expression 25, the voltage $V_{cs2}$ held in the pixel capacitor Cs2 is proportional to the square root of the signal current $I_{sig}$. In other words, the voltage Vcs2 corresponding to the signal current $I_{sig}$ is sampled and held in the pixel capacitor Cs2 by performing the $I_{sig}$ writing operation for the period T4 to T5.

Figure 19:
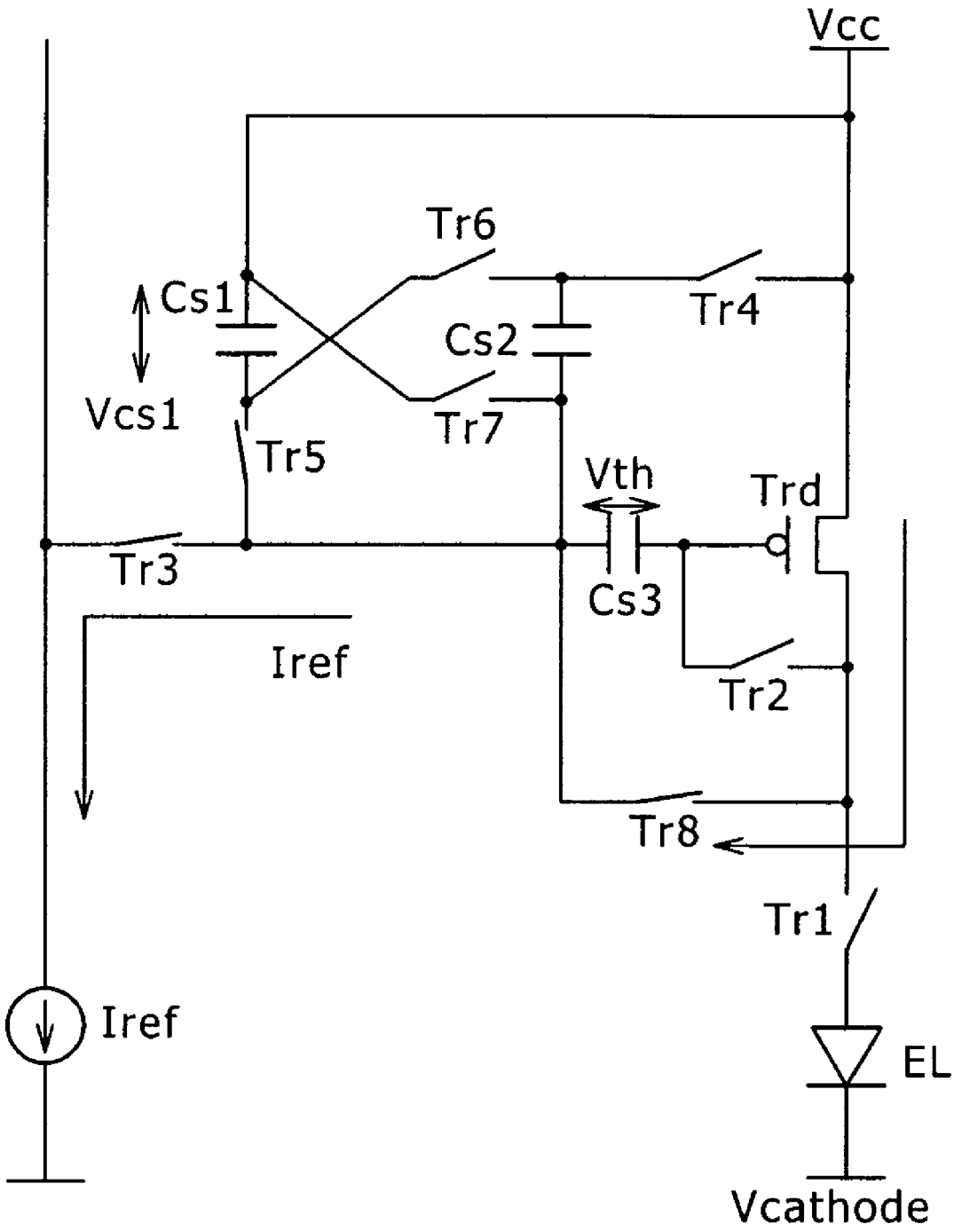
FIG. 19 is a schematic circuit diagram explaining the operation of the pixel circuit shown in FIG. 15.

FIG. 19 is a schematic circuit diagram showing the $I_{ref}$ writing operation which is performed for the period T5 to T6 shown in FIG. 16. When the operation proceeds from the $I_{sig}$ writing operation shown in FIG. 18 to the $I_{ref}$ writing operation shown in FIG. 19, the control line WS2 becomes the low level to turn off the switching transistor Tr4. The states of other switching transistors Tr1, Tr2, Tr3, Tr5, Tr6, Tr7 and Tr8 are maintained as they are. Consequently, as apparent from the comparison of FIG. 19 with FIG. 18, a connection relationship is changed from the connection of the pixel capacitor Cs2 over to the connection of the pixel capacitor Cs1. More specifically, in the $I_{sig}$ writing operation shown in FIG. 18, the pixel capacitors Cs2 and Cs3 are connected in series between the source and gate of the drive transistor Trd, whereas in the $I_{ref}$ writing operation shown in FIG. 19, the pixel capacitors Cs1 and Cs3 are connected in series between the source and gate of the drive transistor Trd. That is, the pixel capacitor Cs2 is merely replaced with the pixel capacitor Cs1 in terms of the circuit operation. At this time, the reference current $I_{ref}$ is caused to flow through the signal line SL instead of the previous signal current $I_{sig}$. More specifically, the reference current $I_{ref}$ is caused to flow from the power source $V_{cc}$ into the signal line SL side through the drive transistor Trd, and the switching transistors Tr8 and Tr3. At this time, a part of the gate voltage $V_{gs}$ developed across the source and gate of the drive transistor Trd is held in the pixel capacitor Cs1. When this voltage is assigned $V_{cs1}$, similarly to the case of Expression 25, $V_{cs1}$ is expressed by Expression 26:

$$V_{cs1} = \sqrt{\frac{2I_{ref}}{k\mu}}$$

Here, as apparent from the comparison of Expression 26 with Expression 25, $V_{cs2}$ is replaced with $V_{cs1}$ in the left member of Expression 25, and $I_{sig}$ is replaced with $I_{ref}$ in the right member of Expression 25. As can be seen from Expression 26, the voltage Vcs1 held in the pixel capacitor Cs1 corresponds to the square root of the reference current $I_{ref}$. In other words, in the $I_{ref}$ writing operation, the voltage corresponding to the reference current $I_{ref}$ is sampled and held in the pixel capacitor Cs1.

Figure 20:
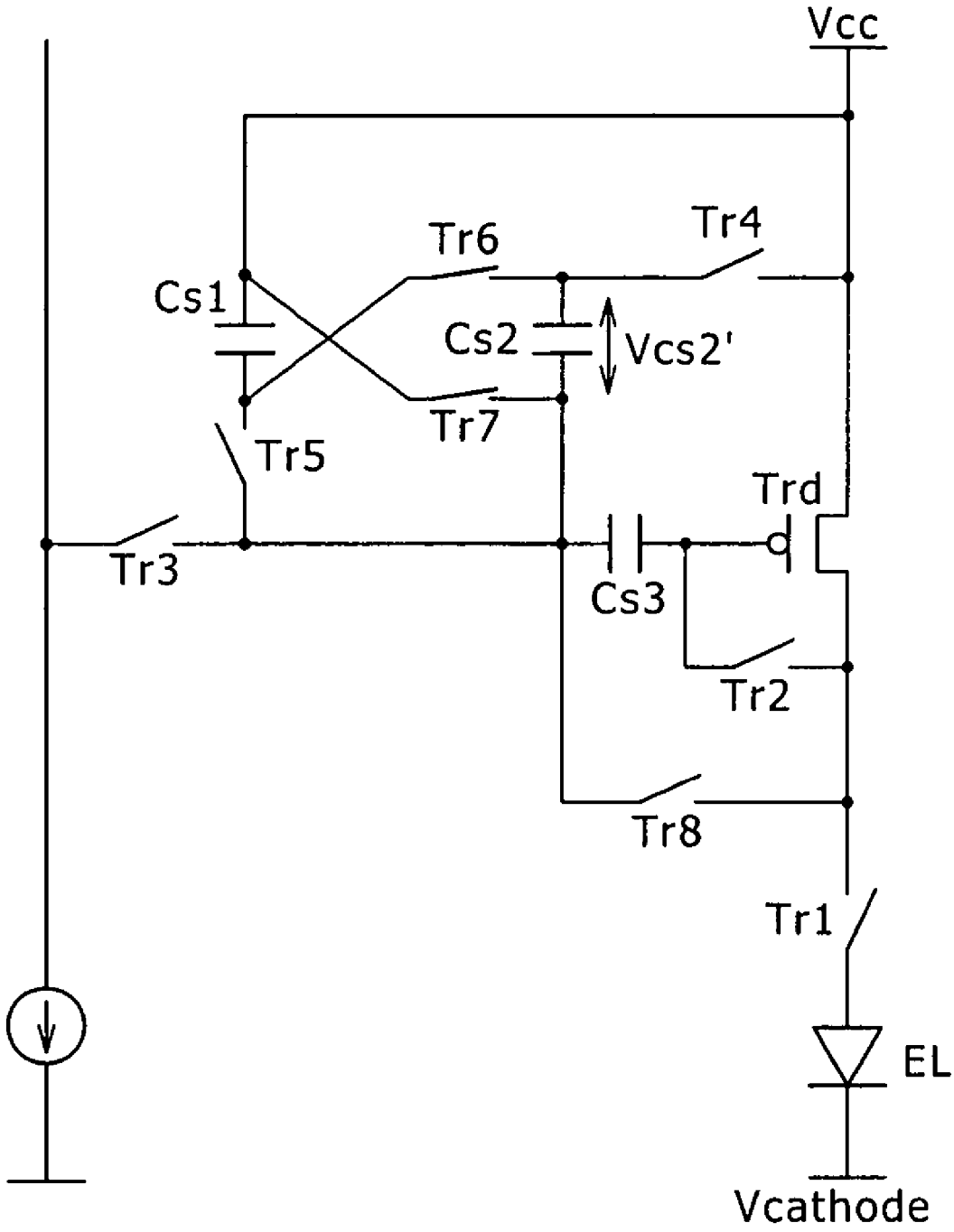
FIG. 20 is a schematic circuit diagram explaining the operation of the pixel circuit shown in FIG. 15.

FIG. 20 is a schematic circuit diagram showing the capacitance canceling operation which is performed for the period T7 to T8 of the timing chart shown in FIG. 16. In this operation, the switching transistors Tr3, Tr5 and Tr8 are turned off, while the switching transistors Tr6 and Tr7 are turned on. As a result, the minus side terminal of the pixel capacitor Cs1 and the plus side terminal of the pixel capacitor Cs2 are connected to each other, and the plus side terminal of the pixel capacitor Cs1 and the minus side terminal of the pixel capacitor Cs2 are connected to each other. Thus, the capacitance cancel for the pixel capacitors Cs1 and Cs2 is performed between $V_{Cs1}$ and $V_{cs2}$. That is, a difference between the voltage $V_{cs1}$ held in the pixel capacitor Cs1 and the voltage $V_{cs2}$ held in the pixel capacitor Cs2 is obtained, and the difference between the voltage $V_{cs1}$ and the voltage $V_{cs2}$ is then held across the pixel capacitor Cs2. Here, when the capacitances of the pixel capacitors Cs1 and Cs2 are equal to each other, a potential $V_{cs2}'$ held in the pixel capacitor Cs2 after the capacitance cancel is given by Expression 27:

$$V'_{cs2} = \frac{V_{cs2} - V_{cs1}}{2} = \frac{\sqrt{I_{sig}} - \sqrt{I_{ref}}}{\sqrt{2k\mu}}$$

As apparent from Expression 27, $V_{cs2}'$ is a value corresponding to a difference between the signal current $I_{sig}$ and the reference current $I_{ref}$. Exactly speaking, the voltage corresponding to the difference between the square root of $I_{sig}$ and the square root of $I_{ref}$ is held as $V_{cs2}'$ in the pixel capacitor Cs2.

Figure 21:
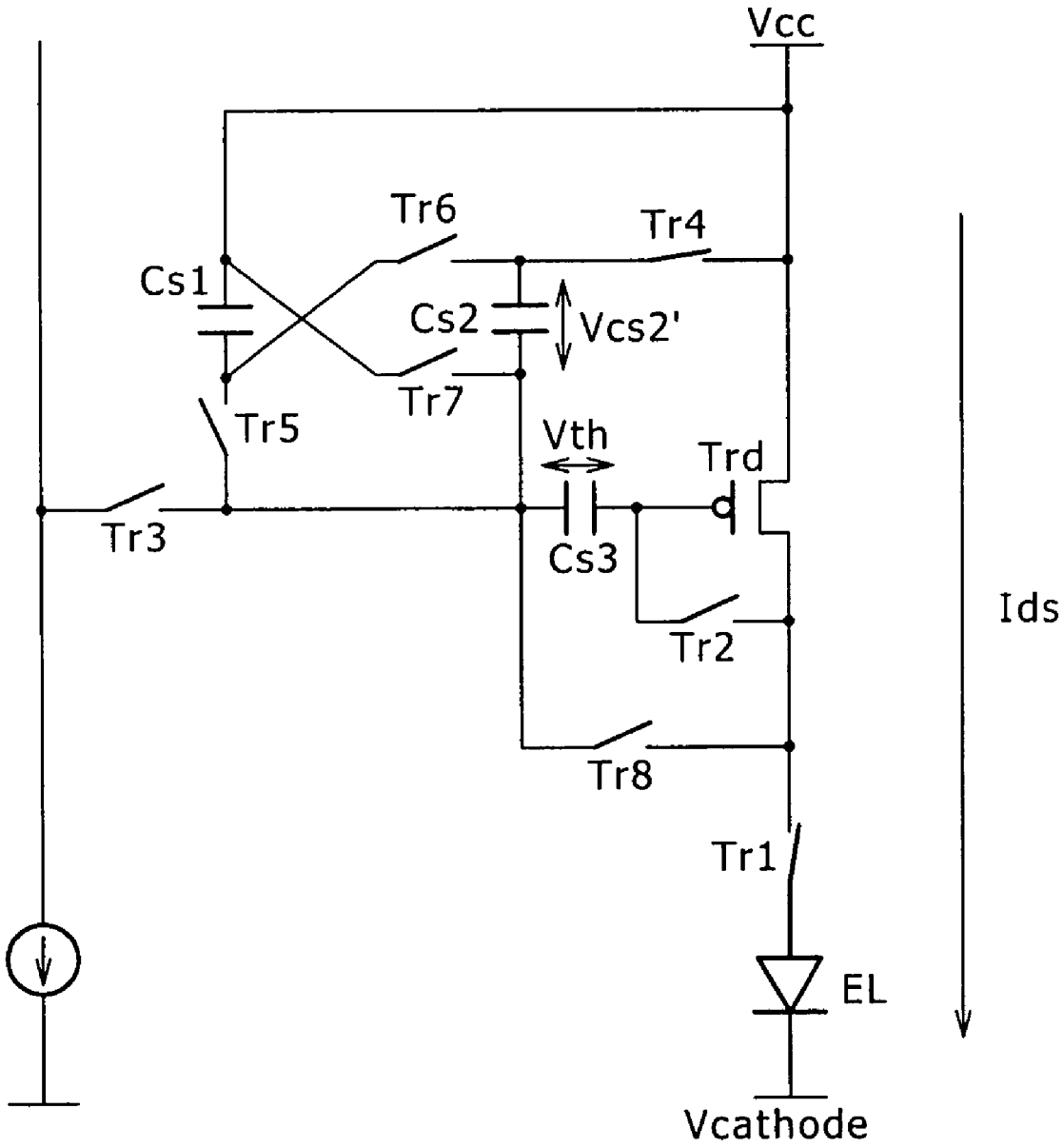
FIG. 21 is a schematic circuit diagram explaining the operation of the pixel circuit shown in FIG. 15.
Figure 22:
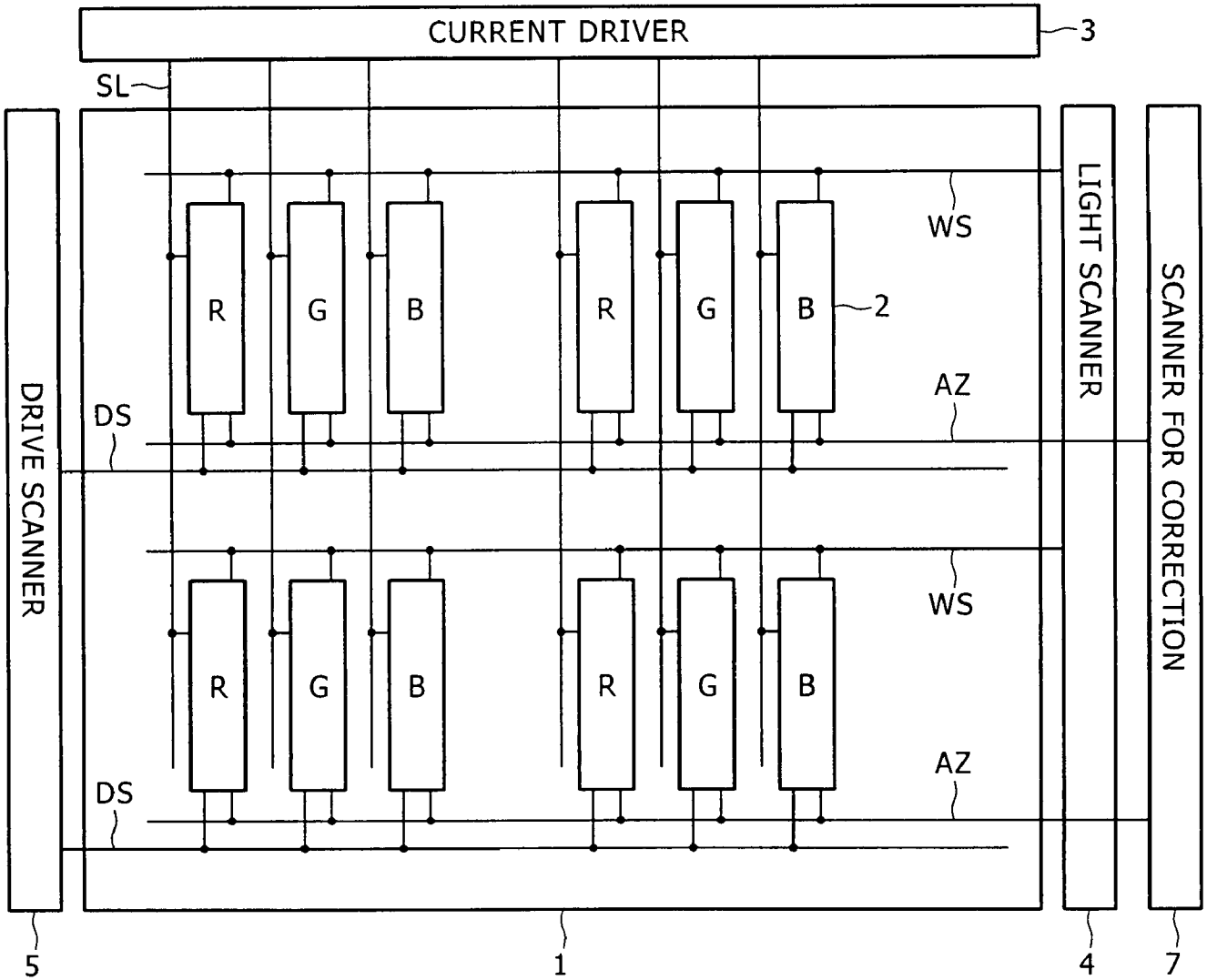
FIG. 22 is an overall block diagram showing an example of a conventional display device.
Figure 23:
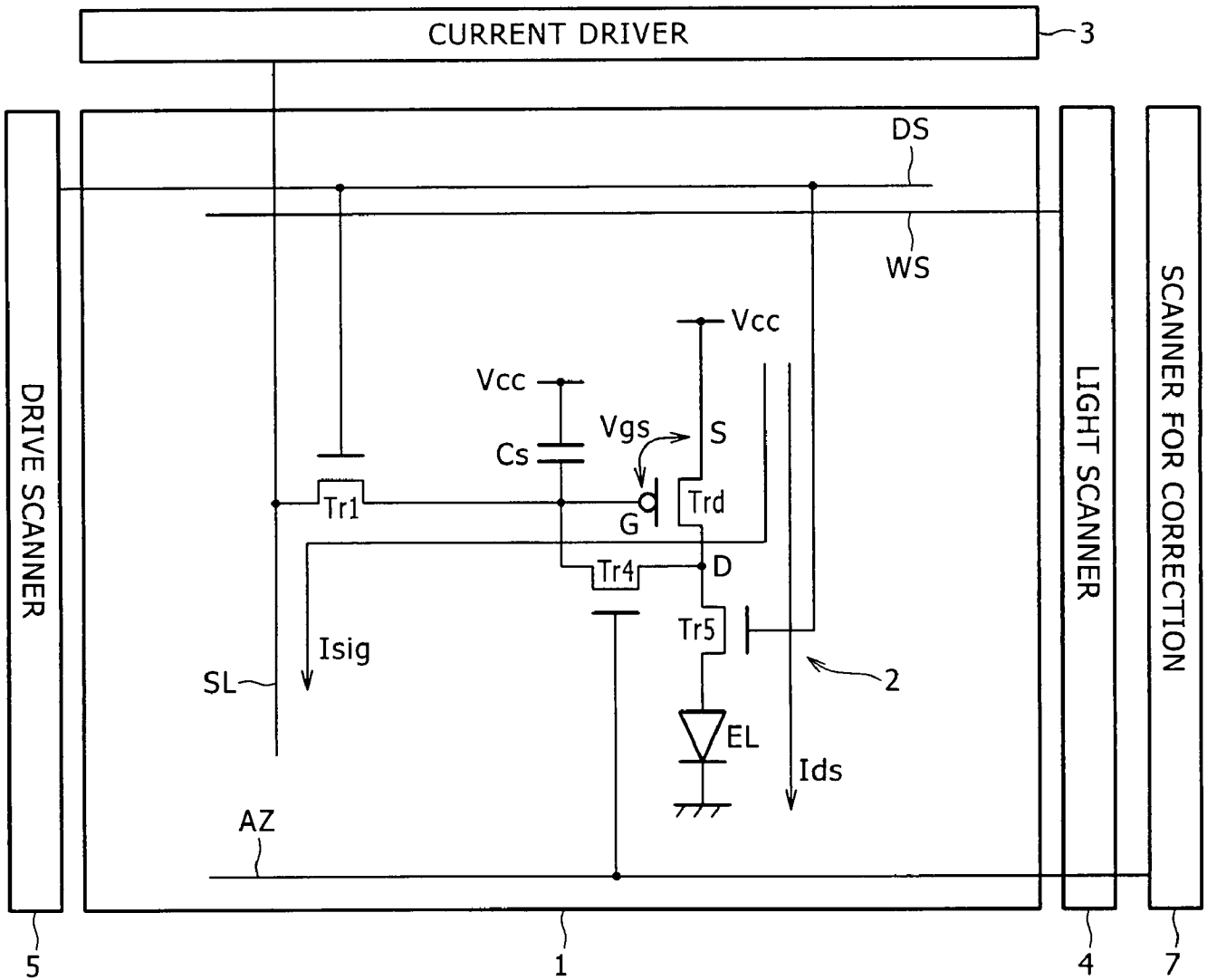
FIG. 23 is a circuit diagram showing a structure of a pixel circuit included in the conventional display device shown in FIG. 22.
Figure 24:
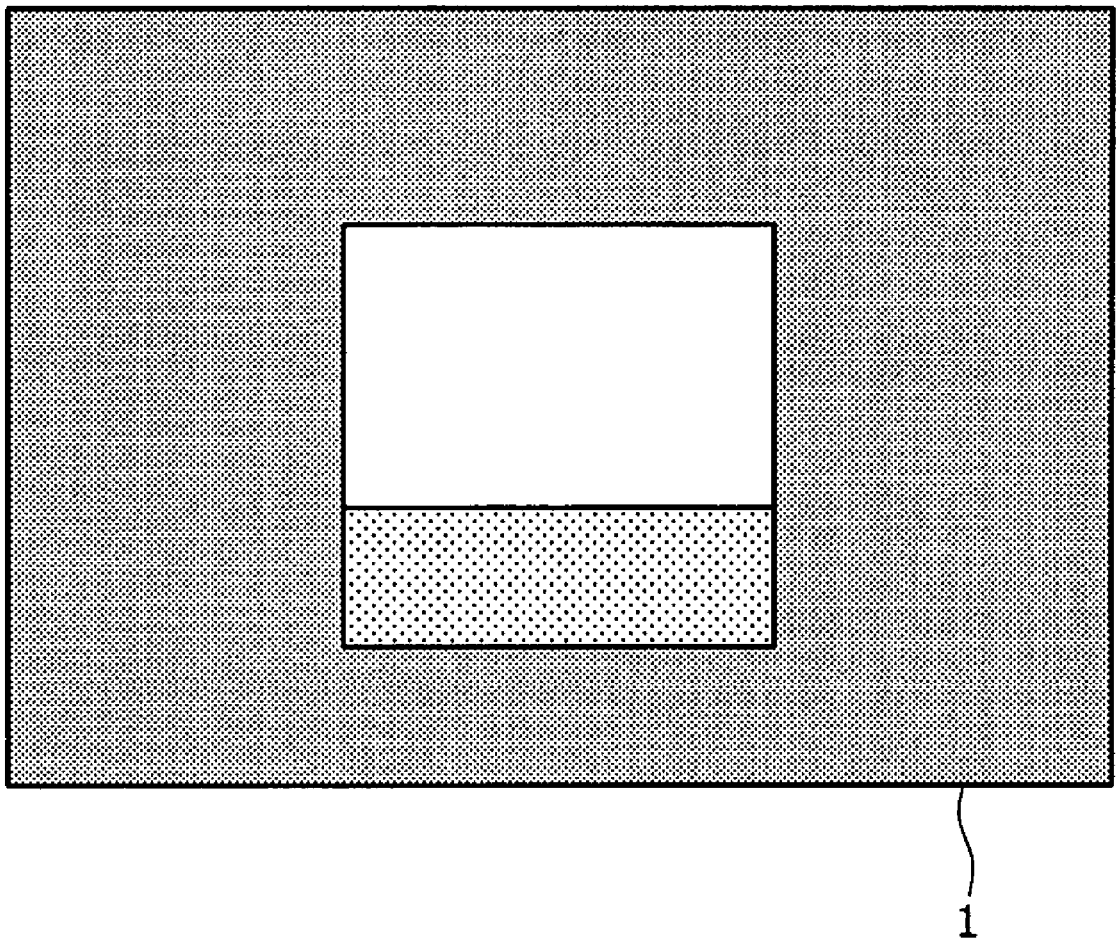
FIG. 24 is a schematic diagram showing an example of a picture of the conventional display device shown in FIG. 22.

FIG. 21 is a schematic circuit diagram showing the capacitive coupling operation and the electroluminescence operation which are performed for the electroluminescence period at and after the timing T9 shown in FIG. 16. At the timing T9, the control signals DS and WS2 become the high level each, while all other control signals WS1, WS3 and AZ are held at the low level each. As a result, the switching transistors Tr4 and Tr1 are turned on while the remaining switching transistors Tr3, Tr5, Tr6, Tr7, Tr2 and Tr8 are turned off. Since the switching transistor Tr4 is turned on, the pixel capacitors Cs2 and Cs3 are coupled to each other between the source and gate of the drive transistor Trd. At this time, the pixel capacitors Cs2 and Cs3 are coupled to each other in a state of holding therein the mutual electric charges because the gate capacity Cg of the drive transistor Trd is sufficiently small. That is, the gate voltage $V_{gs}$ of the drive transistor Trd during the electroluminescence is expressed by $V_{gs}=V_{cs3}+V_{cs2}'=V_{th}+V_{cs2}'$.

When $V_{gs}$ thus obtained is substituted into the basic characteristic expression of the transistor shown in Expression 1, the drive current $I_{ds}$ as expressed by Expression 28 is obtained:

$$I_{ds} = \frac{1}{2}k\mu(V_{gs} - V_{th})^2 = \frac{1}{2}k\mu(V'_{cs2})^2 = \frac{1}{2}k\mu\left(\frac{\sqrt{I_{sig}} - \sqrt{I_{ref}}}{\sqrt{2k\mu}}\right)^2 \frac{1}{4}\left(\sqrt{I_{sig}} - \sqrt{I_{ref}}\right)^2$$

In a first step of Expression 28, $(V_{th}+V_{cs2}')$ is substituted into $V_{gs}$. As a result, $V_{th}$ is canceled and the drive current $I_{ds}$ becomes proportional to the square of $V_{cs2}'$. Moreover, as shown in a second step of Expression 28, Expression 27 is substituted into $V_{cs2}'$. Thereafter, the mobility μ in a denominator and the mobility μ in the coefficient cancel each other and finally, $I_{ds}$ is expressed in the form of a third step in Expression 28. As apparent from Expression 28, the drive current (electroluminescence current) $I_{ds}$ is determined by the current difference value between $I_{sig}$ and $I_{ref}$, and thus it is possible to obtain the image quality, having the high uniformity, which does not depend on the dispersion in threshold voltage $V_{th}$ and mobility μ of the drive transistor Trd. Moreover, in the pixel circuit of the present invention, during the black display, the signal current $I_{sig}$ is set as equal to the reference current $I_{ref}$. As apparent from Expression 28, when $I_{sig}=I_{ref}$, a relationship of $I_{ds}=0$ is obtained and thus the electroluminescence current disappears. As a result, the perfect black display is obtained. On the other hand, even in case of the black display, the absolute value of the reference current $I_{ref}$ can be set to a sufficiently high level, and thus the black signal can be sufficiently written for one horizontal period (1H). As a result, the generation of the black embossing and the longitudinal cross-talk can be suppressed, the perfectly deep black can be expressed, and the high contrast characteristics can be obtained.

As described above, the pixel circuit 2 according to the still another embodiment of the present invention shown in FIG. 15 is disposed in the place where the signal line SL through which the signal current $I_{sig}$ is caused to flow, and the scanning lines WS1, WS2, WS3, AZ and DS through which the control signals are supplied, respectively, cross each other. The pixel circuit 2 is constituted by the electroluminescence element EL, the drive transistor Trd for supplying the drive current $I_{ds}$ to the electroluminescence element EL, and the control portion adapted to operate in accordance with the control signals WS1, WS2, WS3, AZ and DS for controlling the drive current $I_{ds}$ of the drive transistor Trd based on the signal current $I_{sig}$. The control portion includes the first sampling means, the second sampling means, and the difference means. The first sampling means is constituted by the switching transistors Tr3, Tr4 and Tr8, and the pixel capacitor Cs2, and serves to sample the signal current $I_{sig}$ which is caused to flow through the signal line SL. The second sampling means is constituted by the switching transistors Tr3, Tr5 and Tr8, and the pixel capacitor Cs1, and serves to sample the predetermined reference current $I_{ref}$ which is caused to flow through the signal line SL just before or after the signal current $I_{sig}$. The difference means is constituted by the switching transistors Tr6 and Tr7, and a pair of pixel capacitors Cs1 and Cs2, and serves to generate the control voltage $V_{cs2}'$ corresponding to the difference between the sampled reference current $I_{ref}$ and the sampled signal current $I_{sig}$. The drive transistor Trd receives that control voltage $V_{cs2}'$ at its gate G and supplies the drive current $I_{ds}$ caused to flow through its source/drain to the electroluminescence element EL to make the electroluminescence element EL emit light.

When the relative difference between the signal current $I_{sig}$ and the reference current $I_{ref}$ which are sampled by the first and second sampling means, respectively, is small, the amount of electroluminescence of the electroluminescence element EL becomes little, while when the relative difference between the signal current $I_{sig}$ and the reference current $I_{ref}$ is large, the amount of electroluminescence becomes much. However, the absolute levels of the signal current $I_{sig}$ and the reference current $I_{ref}$ are set as large enough to make the sampling possible even when the relative difference is small.

The control portion of the pixel circuit 2 includes the correcting means in addition to the above-mentioned first and second sampling means. The correcting means is constituted by the switching transistors Tr1, Tr2 and Tr7, and the pixel capacitor Cs3, and adapted to detect the threshold voltage $V_{th}$ of the drive transistor Trd to add the detected threshold voltage $V_{th}$ to the above-mentioned control voltage $V_{cs2}'$. As a result, the influence of the threshold voltage $V_{th}$ can be canceled from the drive current $I_{ds}$.

While the preferred embodiments of the present invention have been described using the specific terms, such description is for illustrative purposes only, and it is to be understood that changes and variations may be made without departing from the spirit or scope of the following claims.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A pixel circuit which is disposed in a place where a signal line through which a signal current is caused to flow, and scanning lines through which control signals are supplied, respectively, cross each other and which includes an electroluminescence element, a drive transistor for supplying a drive current to the electroluminescence element, and a control portion adapted to operate in accordance with the control signals for controlling the drive current of said drive transistor based on the signal current, said control portion comprising:

first sampling means for sampling the signal current being caused to flow through said signal line;

second sampling means for sampling a predetermined reference current being caused to flow through said signal line just before or after the signal current; and difference means for generating a control voltage corresponding to a difference between the sampled signal current and the sampled reference current, wherein said drive transistor receives the control voltage at its gate and supplies a drive current being caused to flow through its source and drain to said electroluminescence element to make said electroluminescence element emit light.

2. The pixel circuit according to claim 1, wherein when a relative difference between the signal current and the reference current sampled by said first and second sampling means, respectively, is small, an amount of electroluminescence of said electroluminescence element decreases in size, and when the relative difference between the signal current and the reference current is large, the amount of electroluminescence increases in size, while absolute levels of the signal current and reference current are set at a sufficiently large amount to make the sampling possible even when the relative difference between the signal current and the reference current is small.

3. The pixel circuit according to claim 1, wherein said control portion comprises correcting means for detecting a threshold voltage of said drive transistor to add the detected threshold voltage to the control voltage, so that an influence of the threshold voltage is canceled from the drive current.

4. The pixel circuit according to claim 1, wherein said first sampling means samples a signal voltage generated when the signal current is caused to flow through said drive transistor, said second sampling means samples a reference voltage generated at said gate of said drive transistor when the reference current is caused to flow through said drive transistor, and said difference means obtains a difference between the signal voltage and the reference voltage by coupling the signal voltage and the reference voltage to each other through a capacitor to generate the control voltage.

5. The pixel circuit according to claim 4, wherein, said first sampling means has a first capacitor for holding therein the sampled signal voltage, said second sampling means has a second capacitor for holding therein the sampled reference voltage, said second capacitor being adapted to be coupled to the signal voltage, and said first and second capacitors have the same capacitance value.

6. A display device including a pixel array portion, a driver portion, and a scanner portion, said pixel array portion including column-distributed signal lines, row-distributed scanning lines, and pixel circuits disposed in matrix in places where said column-distributed signal lines and said row-distributed scanning lines cross each other, said driver portion serving to cause signal currents to flow through said signal lines, respectively, said scanner portion serving to supply control signals to said scanning lines, respectively, each pixel circuit including an electroluminescence element, a drive transistor for supplying a drive current to the electroluminescence element, and an intra-pixel control portion adapted to operate in accordance with the control signals for controlling the drive current of said drive transistor based on the signal current, wherein said intra-pixel control portion comprises:

first sampling means for sampling the signal current being caused to flow through said signal line;

second sampling means for sampling a predetermined reference current being caused to flow through said signal line just before or after the signal current; and difference means for generating a control voltage corresponding to a difference between the sampled signal current and the sampled reference current, and said drive transistor receives the control voltage at its gate and supplies a drive current being caused to flow through its source and drain to make said electroluminescence element emit light.

7. The display device according to claim 6, wherein when a relative difference between the signal current and the reference current sampled by said first and second sampling means, respectively, is small, an amount of electroluminescence of said electroluminescence element decreases in size, and when the relative difference between the signal current and the reference current is large, the amount of electroluminescence increases in size, while absolute levels of the signal current and reference current are set at a sufficiently large amount to make the sampling possible even when the relative difference between the signal current and the reference current is small.

8. The display device according to claim 6, wherein, said intra-pixel control portion comprises correcting means for detecting a threshold voltage of said drive transistor to add the detected threshold voltage to the control voltage, so that an influence of the threshold voltage is canceled from said drive current.

9. A method of driving a pixel circuit which is disposed in a place where a signal line through which a signal current is caused to flow, and scanning lines through which control signals are supplied, respectively, cross each other, and which includes an electroluminescence element, a drive transistor for supplying a drive current to said electroluminescence element, and a control portion adapted to operate in accordance with the control signals for controlling a drive current of said drive transistor based on the signal current, said method comprising the steps of:

sampling a signal current being caused to flow through said signal line;

sampling a predetermined reference current being caused to flow through said signal line just before or after the signal current;

generating a control voltage corresponding to a difference between the sampled signal current and the sampled reference current; and applying the control voltage to a gate of said drive transistor and applying a drive current being caused to flow through a source and a drain of said drive transistor to said electroluminescence element.

10. A method of driving a display device including a pixel array portion, a driver portion and a scanner portion, said pixel array portion including column-distributed signal lines, row-distributed scanning lines, and pixel circuits disposed in matrix in places where said column-distributed signal lines and said row-distributed scanning lines cross each other, said driver portion serving to cause signal currents to flow through said signal lines, respectively, said scanner portion serving to supply control signals to said scanning lines, respectively, each pixel circuit including an electroluminescence element, a drive transistor for supplying a drive current to said electroluminescence element, and an intra-pixel control portion adapted to operate in accordance with the control signals for controlling the drive current of said drive transistor in accordance with the signal current, said method comprising the steps of:

sampling a signal current being caused to flow through said signal line;

sampling a predetermined reference current being caused to flow through said signal line just before or after the signal current;

generating a control voltage corresponding to a difference between the sampled signal current and the sampled reference current; and applying the control voltage to a gate of said drive transistor and applying a drive current being caused to flow through a source and a drain of the drive transistor to said electroluminescence element.

* * * * *